US008210256B2

(12) United States Patent
Bridges

(10) Patent No.: US 8,210,256 B2
(45) Date of Patent: Jul. 3, 2012

(54) RADIO FREQUENCY TECHNOLOGY HEATER FOR UNCONVENTIONAL RESOURCES

(75) Inventor: Jack E. Bridges, Park Ridge, IL (US)

(73) Assignee: Pyrophase, Inc., Chicago, IL (US)

( * ) Notice: Subject to any disclaimer, the term of this patent is extended or adjusted under 35 U.S.C. 154(b) by 368 days.

(21) Appl. No.: 11/655,533

(22) Filed: Jan. 19, 2007

(65) Prior Publication Data

US 2007/0187089 A1 Aug. 16, 2007

Related U.S. Application Data

(60) Provisional application No. 60/759,727, filed on Jan. 19, 2006.

(51) Int. Cl.
*E21B 43/24* (2006.01)
*E21B 36/04* (2006.01)

(52) U.S. Cl. ..... 166/248; 166/60; 166/57

(58) Field of Classification Search ..... 166/302, 166/248, 60, 57; 392/304
See application file for complete search history.

(56) References Cited

U.S. PATENT DOCUMENTS 2,757,738 A * 8/1956 Ritchey ..... 166/248
3,547,193 A 12/1970 Gill
3,581,455 A * 6/1971 Scriven ..... 57/290
3,968,432 A * 7/1976 Kelley, Jr. ..... 324/107
4,140,180 A 2/1979 Bridges et al.
4,144,935 A 3/1979 Bridges
RE30,738 E 9/1981 Bridges
4,320,801 A 3/1982 Rowland et al.
4,449,585 A 5/1984 Bridges
4,463,805 A * 8/1984 Bingham ..... 166/248
(Continued)

OTHER PUBLICATIONS

CP Stroemich, FE Vermeulen, FS Chute, E Sumbar "Wellbore Power Transmission for In-Situ electrical heating", 1990, AOSTRA Journal of Research, vol. 6 No. 4, p. 273-294.*

(Continued)

*Primary Examiner* — Cathleen Hutchins
(74) *Attorney, Agent, or Firm* — Nixon Peabody LLP

(57) ABSTRACT

A system for heating at least a part of a subsurface hydro carbonaceous earth formation forms a borehole into or adjacent to the formation, places elongated coaxial inner and outer conductors into the borehole with the inner and outer conductors electrically connected to each other at a depth below the top of the formation, and connects an AC power source to at least the outer conductor to produce heat in at least one of the conductors. The AC output has a controlled frequency, and the outer conductor comprises a standard oil well component made of a ferromagnetic material that conducts current from the AC power source in only a surface region of the conductor due to the skin effect phenomenon. More heat is dissipated from portions of the conductor that is within the depth range of the formation than from other portions of the conductor. The inner conductor may optionally be a standard tubular oil well component made of a ferromagnetic material that conducts current from the AC power source in only a surface region of the conductor due to the skin effect phenomenon.

28 Claims, 15 Drawing Sheets

U.S. PATENT DOCUMENTS

| | | | | | |
|---|---|---|---|---|---|
| 4,476,926 | A | | 10/1984 | Bridges | |
| 4,485,868 | A | | 12/1984 | Sresty et al. | |
| 4,485,869 | A | | 12/1984 | Sresty et al. | |
| 4,498,535 | A | | 2/1985 | Bridges | |
| 4,524,827 | A | | 6/1985 | Bridges et al. | |
| 4,538,682 | A | | 9/1985 | McManus et al. | |
| 4,545,435 | A | | 10/1985 | Bridges et al. | |
| 4,570,715 | A | | 2/1986 | Van Meurs et al. | |
| 4,570,718 | A | | 2/1986 | Adams, Jr. | |
| 4,583,589 | A | * | 4/1986 | Kasevich | 166/60 |
| 4,592,423 | A | * | 6/1986 | Savage et al. | 166/248 |
| 4,620,593 | A | | 11/1986 | Haagensen | |
| 4,660,636 | A | | 4/1987 | Rundell et al. | |
| 4,670,634 | A | | 6/1987 | Bridges et al. | |
| 4,704,514 | A | | 11/1987 | Van Egmond et al. | |
| 4,705,108 | A | | 11/1987 | Little et al. | |
| 4,730,671 | A | * | 3/1988 | Perkins | 166/248 |
| 4,790,375 | A | | 12/1988 | Bridges et al. | |
| 4,793,409 | A | | 12/1988 | Bridges et al. | |
| 4,821,798 | A | * | 4/1989 | Bridges et al. | 166/60 |
| 4,886,118 | A | | 12/1989 | Van Meurs et al. | |
| 4,919,201 | A | | 4/1990 | Bridges et al. | |
| 4,951,748 | A | * | 8/1990 | Gill et al. | 166/248 |
| 5,012,868 | A | * | 5/1991 | Bridges | 166/248 |
| 5,065,818 | A | | 11/1991 | Van Egmond | |
| 5,070,533 | A | | 12/1991 | Bridges et al. | |
| 5,099,918 | A | | 3/1992 | Bridges et al. | |
| 5,126,037 | A | * | 6/1992 | Showalter | 208/370 |
| 5,167,229 | A | * | 12/1992 | Peckham et al. | 607/48 |
| 5,236,039 | A | | 8/1993 | Edelstein et al. | |
| 5,285,846 | A | | 2/1994 | Mohn | |
| 5,293,936 | A | | 3/1994 | Bridges | |
| 5,420,402 | A | | 5/1995 | Bridges et al. | |
| 5,586,213 | A | | 12/1996 | Bridges et al. | |
| 5,621,844 | A | | 4/1997 | Bridges | |
| 5,621,845 | A | | 4/1997 | Bridges et al. | |
| 5,664,911 | A | | 9/1997 | Bridges et al. | |
| 5,713,415 | A | | 2/1998 | Bridges | |
| 5,751,895 | A | | 5/1998 | Bridges | |
| 5,784,530 | A | | 7/1998 | Bridges | |
| 6,023,554 | A | | 2/2000 | Vinegar et al. | |
| 6,112,808 | A | | 9/2000 | Isted | |
| 6,269,876 | B1 | | 8/2001 | De Rouffignac et al. | |
| 6,285,014 | B1 | | 9/2001 | Beck et al. | |
| 6,360,819 | B1 | | 3/2002 | Vinegar | |
| 6,596,142 | B2 | | 7/2003 | McGee | |
| 6,769,483 | B2 | | 8/2004 | De Rouffignac et al. | |
| 6,789,625 | B2 | | 9/2004 | De Rouffignac et al. | |
| 6,929,067 | B2 | | 8/2005 | Vinegar et al. | |
| 7,066,254 | B2 | | 6/2006 | Vinegar et al. | |
| 2003/0098301 | A1 | * | 5/2003 | Lemken | 219/490 |
| 2003/0164240 | A1 | | 9/2003 | Vinegar et al. | |
| 2004/0020642 | A1 | | 2/2004 | Vinegar et al. | |
| 2004/0140096 | A1 | | 7/2004 | Sandberg et al. | |
| 2004/0144540 | A1 | | 7/2004 | Sandberg et al. | |
| 2004/0146288 | A1 | | 7/2004 | Vinegar et al. | |
| 2004/0177966 | A1 | * | 9/2004 | Vinegar et al. | 166/302 |
| 2004/0211554 | A1 | | 10/2004 | Vinegar et al. | |
| 2004/0211557 | A1 | | 10/2004 | Cole et al. | |
| 2004/0211569 | A1 | | 10/2004 | Vinegar et al. | |
| 2005/0006097 | A1 | | 1/2005 | Sandberg et al. | |
| 2005/0092483 | A1 | | 5/2005 | Vinegar et al. | |
| 2005/0199386 | A1 | | 9/2005 | Kinzer | |
| 2005/0199387 | A1 | * | 9/2005 | Wittle et al. | 166/248 |
| 2005/0269077 | A1 | | 12/2005 | Sandberg | |
| 2005/0269089 | A1 | | 12/2005 | Sandberg et al. | |
| 2005/0269090 | A1 | | 12/2005 | Vinegar et al. | |
| 2005/0269091 | A1 | | 12/2005 | Pastor-Sanz et al. | |
| 2005/0269092 | A1 | | 12/2005 | Vinegar et al. | |
| 2005/0269093 | A1 | | 12/2005 | Sandberg et al. | |
| 2005/0269094 | A1 | | 12/2005 | Harris | |
| 2005/0269095 | A1 | | 12/2005 | Fairbanks | |
| 2005/0269313 | A1 | | 12/2005 | Vinegar et al. | |
| 2006/0005968 | A1 | | 1/2006 | Vinegar et al. | |
| 2006/0102625 | A1 | | 5/2006 | Kinzer | |

OTHER PUBLICATIONS

"Square wave signals: Mixed-frequency AC signals" http://www.allaboutcircuits.com/vol_2/chpt_7/2.html.*

"Electrically Enhanced Oil Recovery" by J.E. Bridges and S.E. Johansen, 2 pages (1995).

Allied Tube & Conduit, The Simdex Steel Tube Manufacturers Worldwide Guide, copyright Simdex Publishing, 4 pages.

"Power Converters" from American Superconductor website, http://www.amsuper.com. 3 pages (Dec. 2006).

Independent Pipe and Supply Corp. Specifications (4 pages).

Ambassador Pipe & Supply, "Specialty Needs Outlined" and Carbon Steel Pipe Schedules (3 pages).

"Wellbore Power Transmission for In-Situ Electrical Heating" by C.P. Stroemich, F.E. Vermeulen, F.S. Chute and E. Sumbar, AOSTRA Journal of Research, 22 pages (Jan. 1991).

Power Losses in Steel Pipe Delivering Very Large Currents by C.W. McGee and Fred E. Vermeulen, IEEE Transactions on Power Delivery, vol. 17, No. 1, pp. 25-32 (Jan. 2002).

"Novel Approach to the Synthesis of Microwave Diplexers" by Giuseppe Macchiarella and Stefano Tamiazzo, IEEE Transactions on Microwave Theory and Techniques, vol. 54, No. 12, pp. 4281-4290 (Dec. 2006).

"Physical and Electrical Properties of Oil Shale" Oral Presentation by J.E. Bridges, D.C. Kothari, R.H. Snow and G.C. Sresty, Fourth Annual Oil Shale Conversion Conference, IIT Research Institute, Chicago, Illinois, 46 pages (Mar. 1981).

"Physical and Electrical Properties of Oil Shale" by J.E. Bridges, J. Enk, R.H. Snow and G.C. Sresty, IIT Research Institute, Chicago, Illinois, 20 pages.

"Kinetics of Low-Temperature Pyrolysis of Oil Shale by the IITRI RF Process" by Guggilam C. Sresty, harsh Dev, Richard H. Snow and Jack E. Bridges, 15$^{th}$ Oil Shale Symposium, Colorado School of Mines, Golden, Colorado, 13 pages (Apr. 1982).

"Mathematical Model for In Situ Oil Shale Retorting by Electromagnetic Radiation" by James Baker-Jarvis and Ramarao Inguva, Department of Physics and Astronomy, University of Wyoming, Laramie, Wyoming, 54 pages.

"Promising Progress in Field Application of Reservoir Electrical Heating Methods" by R. Sierra, B. Tripathy, J.E. Bridges and S.M. Farouq Ali, 15 pages (2001).

"Backscatter," Letters to the Editor by Jack E. Bridges, IEEE Microwave Magazine, 2 pages (Dec. 2003).

"Wind Power Energy Storage for *In Situ* Shale Oil Recovery With Minimal $CO_2$ Emissions" by Jack E. Bridges, IEEE Transactions on Energy Conversion, vol. 22, No. 1, pp. 103-109 (Mar. 2007).

"Strategic Significance of America's Oil ShaleResource" by H. Johnson, R. Crawford and J. Bunger, Oil Shale Resources and Technology and Economics, vol. II, "Office Naval Petroleum OilShale Reserves," Washington, DC, 56 pages (Mar. 2004).

"In Situ Retorting of Oil Shale Using RF Heating: A Conceptual Design" by J.R. Bowden et al., presented at the Synfuels 5$^{th}$ Worldwide Symposium , Washington, DC, 19 pages (Nov. 1985).

"Net Energy Recoveries for the In Situ Dielectric Heating of Oil Shale" by J.E. Bridges at al., presented at the 11$^{th}$ Oil Shale Symposium, Golden, CO 50 pages (Apr. 1978).

"Economics of Shale Oil Production by Radio Frequency Heating" by R.G. Mallon, presented at the 14$^{th}$ Oil Shale Symposium, Golden Co., 10 pages (Apr. 1981).

"Development of the IIT Research Institute RF Heating Process for In Situ Oil Shale/Tar Sand Fuel Extraction: An Overview" by R.D. Carlson et al., presented at the 14$^{th}$ Oil Shale Symposium, Golden, CO, 9 pages (Apr. 1981).

"Design, Demonstration and Evaluation of Thermal Enhanced Vapor Extraction System" by J. Phelan et al., Sandia National Lab., Albuquerque, NM, 174 pages (Aug. 1997).

"Comparison of Dielectric Heating and Pyrolysis of Eastern and Western Oil Shale" by J.E. Bridges et al., presented at the 12$^{th}$ Oil Shale Symposium, Golden, CO, 13 pages (Mar. 1979).

STARS Advance Process Thermal Reservoir Simulator Version 2000, Anon, Calgary, AB: Computer Modeling Group Ltd., 2 pages (2000).

"Economic Aspects for Oil Shale Production Using RF in Situ Retorting" by J.E. Bridges and W.S. Streeter, presented at the 24th Oil Shale Symposium Record, Golden, CO, 12 pages (Apr. 1991).

"The Energy Balance of Corn Ethanol: An Update" by Hosein Shapouri et al., Office Chief Economist, Office Energy Policy New Uses, U.S. Dept. Agriculture, Washington, DC, 18 pages (Jul. 2002).

"In Situ RF Heating for Oil Sand and Heavey-Oil Deposits" by J.E. Bridges et al., presented at the Unitar III Conf. Tar Sands Heavy Crude, Long Beach, CA, 12 pages (May 1985).

"Case Study 5: Wind Power Integration Into Electricity Systems" by Debra Justus, OECD Environment Directorate International Energy Agency, Collaboration and Climate Change Mitigation, 32 pages (2005).

"Steady As She Blows" by Peter Fairley, IEEE Spectrum Online Feature Article, 7 pages (Jul. 2006).

International Search Report for Application No. PCT/US07/01646 dated Dec. 5, 2007.

* cited by examiner

RADIO FREQUENCY TECHNOLOGY HEATER FOR UNCONVENTIONAL RESOURCES

CROSS-REFERENCE TO RELATED APPLICATIONS

This application claims priority to U.S. Provisional Application Ser. No. 60/759,727 filed Jan. 19, 2006.

FIELD OF THE INVENTION

Background

Unconventional resources such as oil shale, oil sands and tar sands contain several trillions of barrels in deposits in North America. These deposits require heating to extract the oil. Conventional extraction processes are often costly; in the case of oil shale or oil sands, the resources are first mined and then heated in an above ground process to extract the oil. Such approaches, if applied in large scale, are environmentally difficult and can generate large amounts or $CO_2$ and spent shale or oil sand leavings. Conventional mining and heating methods use thermal diffusion of heat from the outside to the inside of a block of oil shale; this takes a long time, unless the size of the volume being heating is very small.

To mitigate the cost and environmental issues, in situ heating methods that require minimal mining and no-on site combustion have been studied. RF (radio frequency) dielectric volumetric heating has been successfully demonstrated to heat oil shale and tar sand deposits to recover petroleum liquids and gases. In the case of volumetric heating, the heat is liberated within the formation, similar to that for microwave ovens. This approach is most appropriate where access to the surface above the shale deposit is limited and where heating times are in the order of months.

Alternatively, in situ thermal conduction (diffusion) heating methods, such as Shell Oil's ICP process, are currently being field tested in Colorado. According to newspaper interviews, Shell inserts heaters into the ground several hundred feet to reach shale rock. Electrical heaters bring temperature gradually up to 650-700 degrees F. (343-377 C.). The extracted product is two thirds oil and one third gas. Much experimenting remains to design and build the most efficient and cost-effective heaters. The tests have been ongoing for at least five years. So far, the challenge has been finding an efficient heater that can keep a steady temperature of about 600 degrees F. (about 330 C.) over a period of months or years. This method is most appropriate for very thick rich oil shale deposits and where heating times are in the order of years.

During the early 1950's and later, in situ tubular thermal diffusion heating methods were used to heat heavy oil or paraffin-prone reservoirs to stimulate the flow. For this, down-hole tubular resistance heaters were used, but these experienced reliability problems. While many installations were tested in the USSR and California during the 1950's to 1960's, these resistance heating methods are not widely used today.

Commercially available emersion tubular elongated resistors have been used down hole for oil field applications as noted above, but are relatively fragile. These are usually in the form a long, thin-walled steel sheath about a millimeter thick. The sheaths contain an insulating powder that surrounds a concentric very thin resistance heating wire. The thin resistance wire must be operated at a very high temperature so as to transfer a reasonable amount of heat through the insulating powder, and then though the thin-wall tube or sheath and thence into the surrounding material.

Ljungstrum U.S. Pat. No. 2,732,195 (1956) and U.S. Pat. No. 2,780,450 (1957) disclose the use of tubular electrical heaters to extract oil from oil shale.

Van Muers U.S. Pat. No. 4,570,718 (1986) discloses a method of heating long intervals of earth formation at high temperatures for long times with an electrical heater containing spoilable steel sheathed, mineral insulated cables at temperatures between 600 and 1000 C. The heating profiles along the borehole are correlated with the heat conductivities of the earth formations.

Van Egmond U.S. Pat. No. 4,704,514 (1987) discloses tubular electrical resistance heaters which were capable of generating heat at different rates at different locations by having a conductor with a thickness which is different at different locations.

Van Muers U.S. Pat. No. 4,886,118 (1989) discloses a conductively heated borehole in oil shale at over 600 C. to create horizontal fractures that extend to producing wells.

Vinegar U.S. application Ser. No. 080,683 (1998) discloses a coaxial heating system which uses infra red transparent electrical isolation material between the inner and outer conductors.

De Rouffignac U.S. Pat. No. 6,269,876 (2001) discloses a heating system that uses a porous metal sheet that is surrounded by electrical insulating material.

Vinegar U.S. Pat. No. 6,360,819 (2002) discloses a coaxial heating system that uses ceramic insulators that are connected to a support element for conducting the heat from the ceramic insulators and radiating heat into the well bore.

De Rouffignac U.S. Pat. No. 6,769,483 (2004) discloses a coaxial arrangement where the outer conductor/sheath placed in a shale deposit, where the outer conductor is enclosed at the bottom to prevent fluids from entering, where and the inner conductor is the heating element that is isolated from the sheath by ceramic insulators that allow the presence of gas and where the inner conductor contacts the outer conductor or sheath at the bottom of the borehole by a sliding contact.

Vinegar U.S. Application No. 2004/0211554 (2004) discloses an in situ heating method wherein a heating conductor is placed within a conduit in the formation and wherein the heating conductor is clad with a lower resistance material to reduce the dissipation in overburden regions.

Sandberg U.S. Application No. 0006099097 (2005) discloses a variable frequency heating system that uses frequencies between 100 and 1000 Hz and that uses a nickel conductor configured to produce a reduced amount of heat within about 50 C. of the curies point, and where the skin depth is large compared with the diameter of the controlled heating conductor.

Vinegar U.S. Application No. 2006/0005968 as well as Sandberg U.S. Application Nos. 2005/0269077, 2005/0269089, and 2005/0269093 note the use of skin effect in ferromagnetic materials and wherein the power supply is configured to provide a modulated DC in a pre-shaped waveform to compensate for the phase shift and the harmonic distortions.

Other casing and tubing heating methods have been considered. For example, the use of eddy current heating techniques is noted in Isted U.S. Pat. No. 6,112,808 (2000). He describes an eddy current method to heat short segments of casing that are embedded in the producing formation. The heated sections are positioned to selectively heat the casing in the vicinity of the producing zone in a heavy oil deposit.

The use of down-hole transformers is noted by Bridges in U.S. Pat. No. 5,621,844 (1997). He describes the use of a down-hole transformer designed to apply very high currents needed to heat a short segment of the casing which is positioned within the producing zone. The resistance of the short segment is very small, thereby requiring very high currents to heat the casing. This arrangement enhances the flow rates of heavy oil into the borehole. Frequencies greater than 60 Hz are used to reduce the size of the down hole transformers.

Bridges U.S. Pat. No. 4,790,375 (1988) discloses preventing the deposition of paraffin with an electrically heated tubing system that just compensates for the heat loss as heavy oil or paraffin-prone liquids flow upward. A ferromagnetic tubing segment is positioned from a warm mid-reservoir point into the cooler region near the surface. By proper selection of the length of the heated tubing, the frequency and the power, the heating can be controlled such that the energy dissipated along the tubing just overcomes the heat losses from the tubing. The frequency ranges from 50 Hz to 500 kHz and chosen such that the skin depth is less than the wall thickness of the tubing. Little heat is transferred into the formation; operating temperatures do not exceed 300 F.

A tubing heating installation to prevent the deposition of paraffin was offered commercially as noted by Ravider (2001). Via a 60-Hz transformer, heating currents were excited on a ferromagnetic tubing that was electrically isolated from the casing. A very high turn ratio was used to transform 440 V power to the very low voltage, high current needed to heat the tubing. One limitation was the high power consumption.

SUMMARY OF THE INVENTION

To respond to this challenge to develop more reliable in situ resistance heaters that are immune to variations in the thermal properties along the borehole, this invention provides a novel, robust, tubular heating system that can be installed in an unconventional resource such as oil shale, and that can be modified, if needed, to maintain essentially a constant temperature, e.g., from about 360 C. to about 750 C. The invention can be configured and operated to electrically vary the heating rate for one segment compared to another segment. In addition, it uses robust conventional oil field components and installations methods; it can be assembled on site to tailor the heating pattern for each specific site. It can withstand higher temperatures, e.g., >750 C. It can be used either for an improved heat-only well or as an improved combined heat-and-produce well. It can provide downhole heating for hot water floods. Temperature sensors can be conveniently installed without perturbing the electrical heating features, and the results can be used to control the temperature. In certain cases, it offers a possibility of faster oil recovery.

This invention offers the opportunity to heat via thermal diffusion other unconventional resources, such as oil sands, tar sands, oil-impregnated diatomaceous earth deposits, coal deposits and viscous heavy oil deposits and other bitumen accumulations. Also, it may be amenable to heat non-hydrocarbon mineral deposits, such as nahcolite or dawsonite. It also can be used heat other mineral deposits by thermal diffusion and accelerate recovery of valuable minerals by solution mining. The thermal diffusion process can be configured, especially for long lengths, where the length of the run is many times the diameter of the borehole, such as for a long horizontal well to heat injection water and the transfer the heat by convection into certain deposits.

A goal of this invention is to develop a very robust RFT (Radio-Frequency-Technology) thermal diffusion tubular or rod-like heater system to extract fuel from unconventional deposits, such as oil shale, using for the most part conventional oil field components, such as 0.5% carbon steel tubing or casing. Another goal is to be able during field installation to change the material or geometry of the conductors to tailor the heating pattern in accordance with the reservoir properties of the deposit or product recovery methods. Another goal is to tailor the geometry and materials of the tubular conductors to resist down-hole pressures and stresses without impairing the heating functions. Another goal is to use conventional oil field components and installation method. Other goals are to be able to use the system either as heat-only to stimulate production, or as a combination heater/product-collector version; limit the temperature of a segment of a heater to a specific value; to vary electronically the dissipation over one segment of the formations relative to other segments; to reduce the time needed to extract fuels for a given deposit by increasing the power deliverability from about 1 W/m to 10's of kW/m; to provide simple means to install temperature sensors to monitor and control the heating; to avoid crushing the tubing as the oil shale being heated expands; and to make the apparatus robust enough to withstand any damaging effects of a hot spot that can arise from the heterogeneity of the thermal properties of the deposit.

Another goal is to use large-diameter surfaces that are the principal source of heat. This avoids the need for high-temperature materials used for the small heated filaments or thin rods in the traditional coaxial heater. This leads to greater reliability and more rapid deposition of heat into the deposit.

DETAILED DESCRIPTION OF PREFERRED EMBODIMENTS

This invention utilizes frequency-variable electromagnetic RFT heating techniques to heat commonly available (although not limited to) magnetic low carbon steel tubing or rods, such as used in oil fields. RFT heating techniques include technology used to design radio-frequency communication systems that employ frequencies as low as 7 Hz (such as the Schuman Resonance proposed for submarine command and control) and up to 5 MHz (for short wave communications).

Figure 1B:
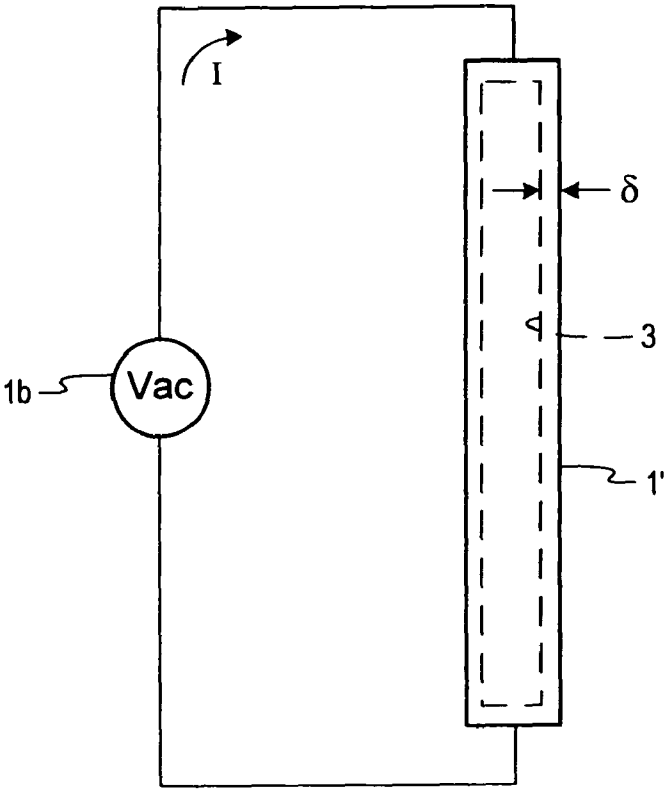
FIG. 1 illustrates the electrical characteristics of a non-magnetic conducting rod with those for a ferromagnetic conducting rod.
Figure 1A:
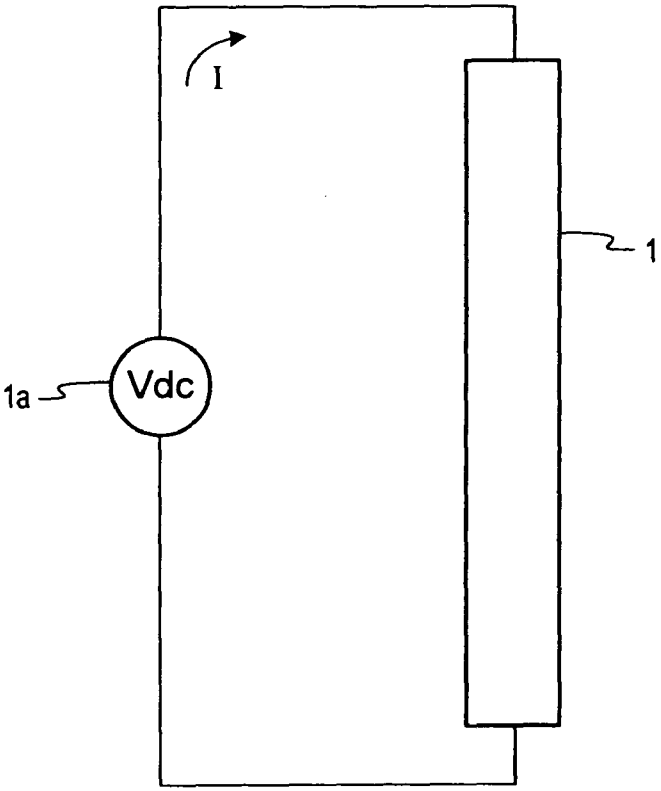

To illustrate, FIG. 1*a* represents a 1 meter long thin (e.g., about 3 mm) diameter rod 1 of magnetic steel. This rod is connected to a d-c voltage source 1*a*. The current, I through the rod is simply determined by dividing the d-c source V by the resistance of the rod (e.g., about $1.6\times10^{-2}$ ohms). If connected to 1-volt source, over 60 watts would be dissipated. To lower the dissipation to 10 watts, the diameter of the rod would have to be substantially reduced by a factor of 2 or 3 (this is why the filaments in light bulbs are so very thin and fragile for use with conventional household wiring of 120 or 240 volts).

Now if the d-c source 1*a* is replaced with a variable frequency a-c source 1*b* such as shown in FIG. 1*b*, and the rod 1 is replaced with a 0.5% carbon steel rod 1' which has a large magnetic permeability, the apparent resistance (or impedance Z), V/I remains the same until the frequency is increased to over 100 Hz, in which case the ratio of V/I progressively increases. Thus by increasing the frequency, the current flow I can be reduced to a point where higher, more tractable voltage sources can be used with thick robust rods or tubing rather than thin wires or sheaths.

The preferred frequency-variable power sources that are needed for the RFT heaters efficiently recover the energy in that has reactive or harmonic content. These sources require the use of semiconductor devices which do not operate efficiently where the output voltage is much less than a few volts, and operate most efficiently where the required output voltages are in the range of 10 volts and higher. Even lower output voltages are possible with the use of step down-hole transformers. Notwithstanding this requirement, low voltage outputs may require higher current carrying cables that are costly and inconvenient to install. The down-hole conductor or must also be large to avoid unneeded losses.

Skin Effect Phenomena: Resistive and Reactive

This phenomena is caused by skin effect, which causes the current to flow only near the surface of the rod to a depth, δ, called the skin depth 3. This decreases the cross section of the rod, as illustrated in FIG. 1*b*, thereby increasing the apparent resistance of the rod. The skin depth also introduces an inductive component that is comparable in magnitude to the apparent resistance.

Based on linear, time-invariant parameters, rigorous relationships to estimated skin effects are available as follows:

$$Z_0=[\pi r^2\sigma]^{-1/2} \text{ ohms per meter} \quad (1)$$

for very low frequencies $$Z_{hf}=[1+j]\times[2\pi r\ \sigma\delta]^{-1} \text{ ohms per meter} \quad (2)$$

for high frequencies where $r>>\delta$ and where $[2\pi r\ \sigma\delta]^{-1}$ is the resistance term and where $j[2\pi r\sigma\delta]^{-1}$ is the inductive impedance, where r is the rod radius, σ is the conductivity, δ is the skin depth, and $j=[-1]^{1/2}$ $$\text{and } \delta=[\pi f\mu\sigma]^{-1/2} \text{ per meter} \quad (3)$$

where $\mu=\mu_o\mu_r$ and $\mu_o=1.2\times10^{-6}$ and $\mu_r$ is the relative permeability From the above, it can be seen that the skin depth is smaller for higher frequencies, higher conductivities, such as found for 0.5% carbon steel. These data show that the power dissipation is largely independent of the wall thickness of the tubing, thereby permitting the use of tubing with thick walls.

The frequency-variable power sources that are used for the RFT heaters preferably efficiently recover the energy in the reactive or harmonic content. These sources require the use of semiconductor devices, which do not operate efficiently where the output voltages are much less than a few volts, and operate most efficiently where the required output voltages are in the range of 10 volts and higher. Notwithstanding this requirement, the low voltage outputs require higher current carrying cables that are costly and inconvenient to install. The down-hole conductor must also be large to avoid unneeded losses.

Figure 2A:
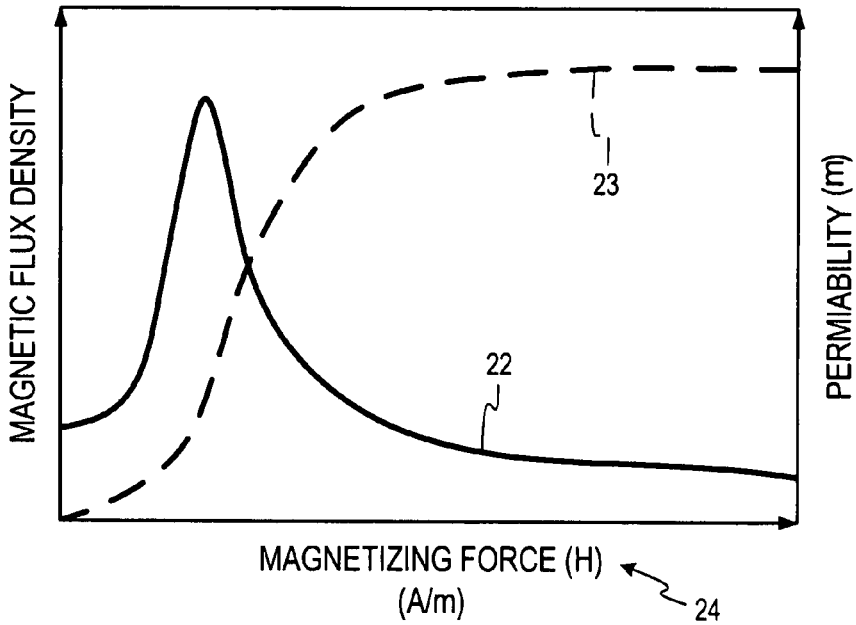
FIG. 2 shows how the circumferential magnetic field intensity within the outer ferromagnetic conductor is induced by the current flowing on an inner conductor.

The above does not take into account the non-linear and time-dependent properties of magnetic materials. Of importance is the variation in the magnetic permeability, μ, of the steel as a function of the magnetizing force, H (usually noted in A/m). FIG. 2*a* shows a simplified plot of the permeability 22 as a function of the magnetizing force 24 in A/m. Also plotted is the magnetic flux density 23 (B).

Figure 2B:
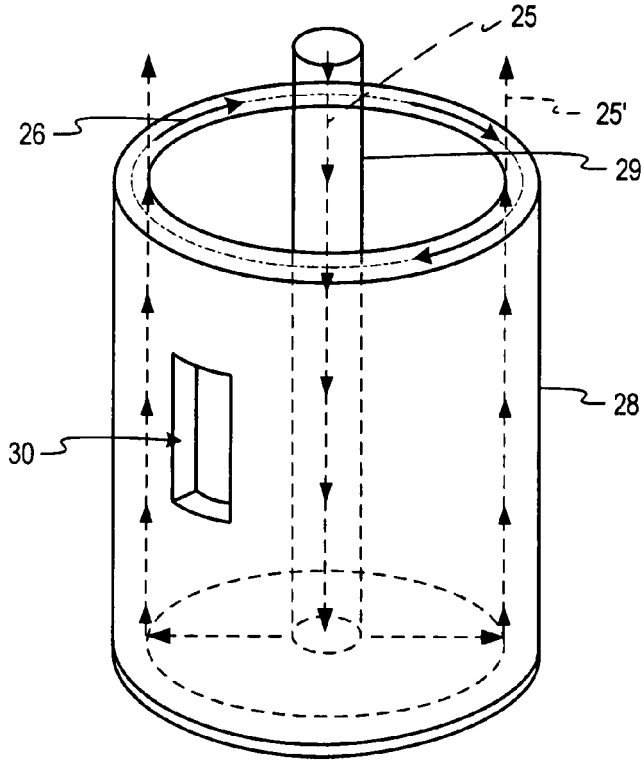

FIG. 2*b* shows a coaxial, two-conductor configuration where the current 25 in the center conductor 29 produces a circumferential magnetic field intensity 26 in an outer conductor 28 that comprises a ferromagnetic material. As shown in FIG. 2*a*, the permeability 22 and magnetic flux density 23 are functions of the magnetic field intensity 24. This arrangement produces large values for the permeability and flux density and accounts for large variations in the skin depth as a function of the current 25. If an air gap 30 is introduced, it can reduce the permeability and the extent of variations in the skin depth.

For coaxial symmetry, the magnetic fields external to the outer conductor are cancelled when the downward and upward total currents 25 and 25' are the same. This effect, in combination with the skin effect causes the currents to be confined to the inner surfaces of the coaxial conductors. These combined effects allow, for small skin depths, the electrical and mechanical designs to be independently considered, thereby permitting both a robust mechanical design where needed and an effective heating design.

Hysteresis effects also exist and are dependent on the composition and manufacturing processes used to produce the ferromagnetic material. Unlike the skin effect, hysteresis power absorption is roughly proportional to the frequency.

Figure 4:
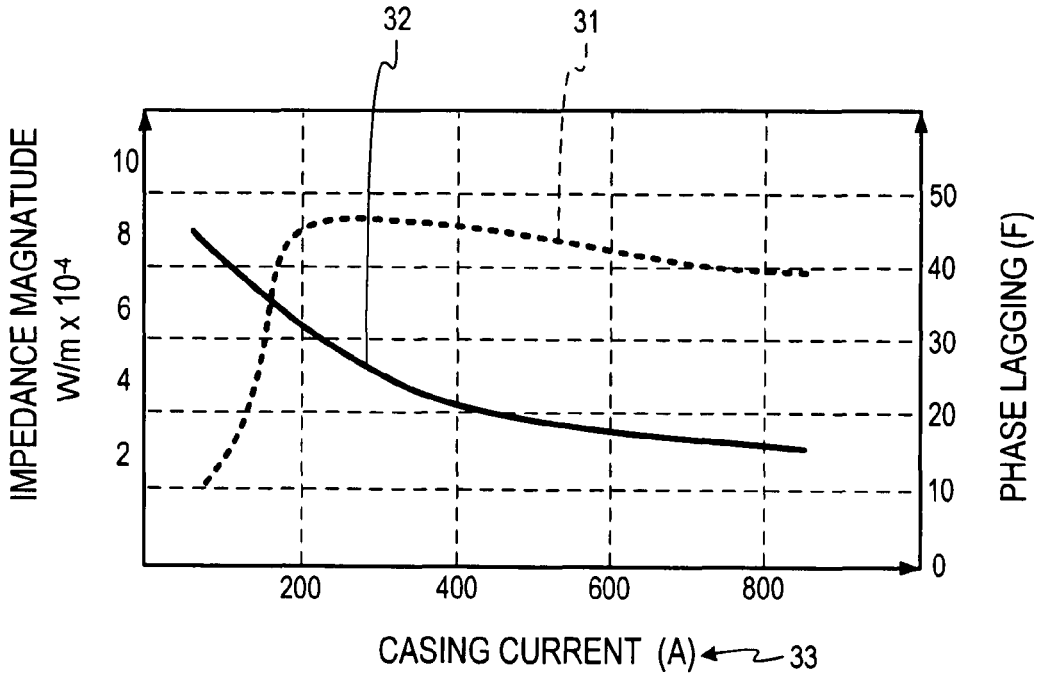
FIG. 4 plots the magnitude of the surface impedance and inductive phase angle as a function of the current for a typical ferromagnetic oil well casing.

Because of these complexities, a surface impedance concept is used and is determined by measuring the voltage drop along the surface of a conductor and dividing it by the current. As shown in FIG. 4, this surface impedance 31 is measured as a function of the rod or tube current 32 and the frequency for a specific material and size of rod or tubing. It can be seen that the phase angle 33 is lagging, which is a measure of the inductive reactance. At small casing currents, the measured inductive reactance is equal to $[+j]\times[2\pi r\sigma\delta]^{-1}$ as based on linear assumptions where the phase angle is 45 degrees lagging. The phase angle or inductive reactance decreases as the casing current increases. At low casing current, the measured inductive reactance is comparable to the resistive component, $[2\pi r\sigma\delta]^{-1}$, as estimated by the above-noted linear parameters.

Electrical energy is stored in this inductive component and is preferably recovered to avoid significant reduction in the power delivery efficiency. Further, the non-linear and time-dependent variations can generate harmonics. Assuming 60 Hz excitation, odd-order harmonics at 180, 300, 420 Hz are generated. These, in addition to the skin effect reactive component, can lead to inefficiencies and power line interference if not properly treated.

Impact of Skin Effect Phenomena

The above phenomena (see Fields and Waves, Ramo, 1965, p. 294) are considered in optimizing the design of the RFT heater for unconventional deposits. These considerations are:

1. In the case of coaxial conductor geometry, the currents will flow on the outside surface of the inner conductor and on the inside surface of the outer conductor. This makes the design of the RF heater almost independent of the thickness of the outer conductor, thereby permitting a robust wall thickness when needed without affecting the electrical performance.

2. As opposed to many conventional heater designs (see, e.g., Sandberg (2003)), the inner conductor of the RF heater can be so operated that the skin depth is very small compared to the radius of the heaters, thereby reducing the need for expensive high resistivity metals.

3. The power dissipated in the RFT heaters is a function of the current, and cannot be predicted based on a simple measurement of the surface impedance. Thus the power dissipated in the tubing is proportional to $VI[\cos\Phi]$ where $\Phi$ is the phase angle between the applied voltage V and the resulting current I. Therefore, the real power dissipation can be measured as $VI\ [\cos\Phi]$ by simultaneously measuring both the current and the voltage and the relationship between these parameters.

4. For the idealized relationships noted above, the reactive power has about the same amplitude as the real component of the dissipated power. The energy in this reactive power can be recovered.

5. Similarly, the reactance will also vary as a function of the current through the conductor and the reactive power is proportional to $VI[\sin\Phi]$. These parameters can be considered to help recover the reactive power.

6. The permeability is a highly non-linear function of the current in the rod, tubing or casing, and therefore creates harmonics in the current in the conductors if a constant voltage source is used; it will create harmonics in the applied voltage if a current source is used. Therefore provision is made, in addition to recovering reactive power, to recover both the real and reactive power in the harmonics.

Comparison with Conventional Tubular Heaters

Figure 3B:
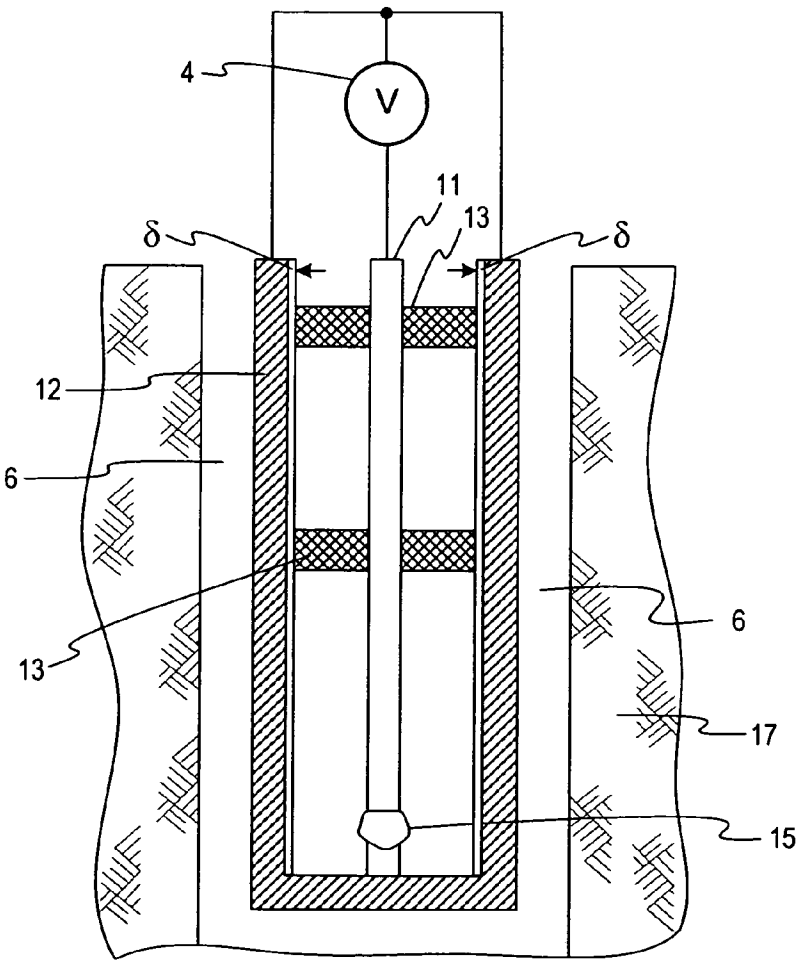
FIG. 3 compares the traditional, thin-walled, tubular electrical heater for in situ installation with a thick-walled, skin effect magnetic casing heater.
Figure 3A:
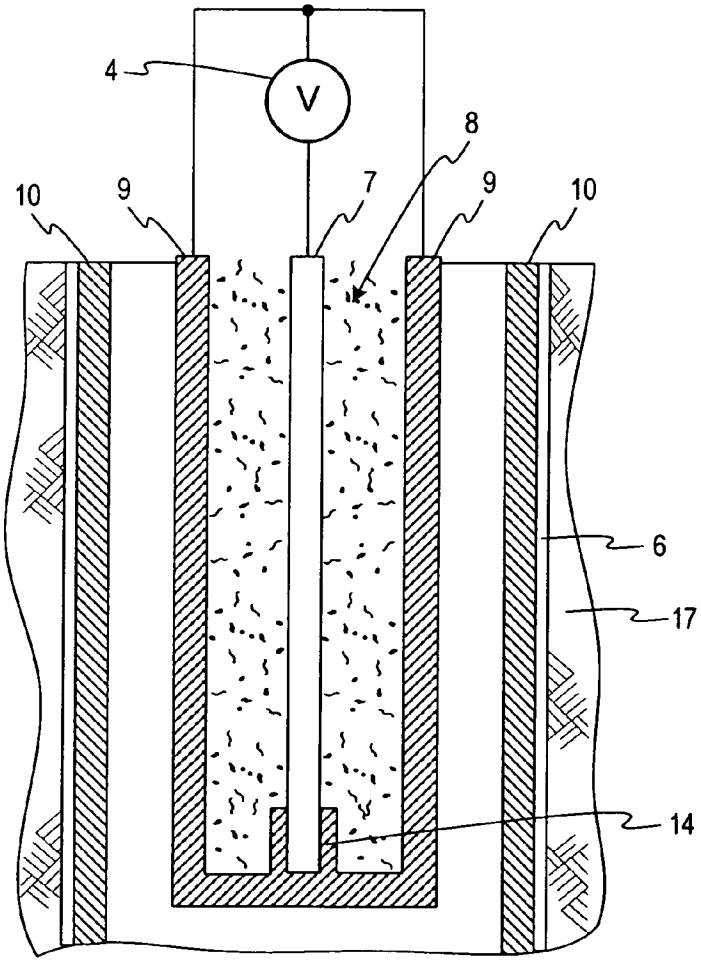

FIG. 3*a* illustrates a currently available commercial heating resistor. A center conductor 7 is composed of a special alloy that has a high resistivity and high temperature melting point. Its diameter is typically in the order of millimeters. This heating conductor 7 is surrounded by electrical insulating powder 8 that is compacted between the center conductor 7 and an outer sheath 9 that has a thickness in the range from a few to ten millimeters. The inner conductor 7 is usually electrically isolated from the sheath 9 to prevent electrical shocks. As such, electrical potentials are applied only to each end of the center conductor. Where electrical safety permits, the distal end of the inner conductor can be connected to the sheath 9 as is shown in FIG. 3*a*.

To heat oil shale 17, the heater assembly of FIG. 3*a* is inserted via a borehole 6 into an oil shale deposit. The heating rod or filament 7 is operated at a very high temperature that can transfer much of the heat via thermal conduction through the insulating powder 8 to the walls of the sheath 9. The sheath in turn transfers heat via radiation to a conduit 10 and thence via radiation to the side of the borehole 6. The conduit 10 is optional, but can be used to assist in the installation and to prevent the fragile sheath 9 from being crushed by the expansion of the shale into the borehole during heating. The use of an extra large borehole 6 can be used as a shale swelling volume to prevent crushing the heating system and also to assure that all of the heat transfer is by thermal radiation. Electrical contact between the heater rod 7 and the sheath 9 is made via a sliding contact switch 14.

FIG. 3*b* characterizes the basic arrangement for an improved RFT heating system. A 10-mm-diameter inner conductor 11 is composed of non-magnetic stainless steel that exhibits a very low, frequency-independent resistance. Aluminum can be used for this conductor, assuming that temperatures are kept below 650 C. and that the gases between the inner conductor 11 and an outer conductor 12 are non-corrosive. The outer conductor 12 is a standard 0.5% magnetic, carbon steel oil well casing, e.g., 3.5 inch diameter. The inner conductor 11 is electrically isolated from the casing 12 by spaced ceramic high temperature centralizers 13, which have been widely used for decades in radio frequency high power coaxial cables. The inner conductor 11 is connected at the deep end to the 3.5 inch casing by means of a steel tubing and an expansion joint and a tubing anchor system 15. This arrangement is more robust that the sliding contact.

As shown in the FIG. 3*b*, the space between the inner and outer conductor is open and not filled with a dielectric powder. Depending on the operating temperature, it could be filled with a non-corroding gas or a silicone oil to preclude intrusion of unwanted fluids.

The resistance of a 3.5-inch-diameter casing is very low for 60 Hz electrical power sources and, as such, needs 1000's of amperes for 60 Hz power. To reduce the needed current to tractable values, the frequency of the source can be increased. As the frequency is increased, a skin effect phenomenon occurs that causes the current to flow in progressively thinner and thinner regions $\delta$, within the inner surface of the outer conductor 12, which is magnetic. This causes the effective resistance of a 3.5-inch-casing to increase to a point where it is practical to deliver up to 100 kW power or more using commercially available RF power-semiconductor sources.

The ratio of the a-c impedance of a ferromagnetic casing to the d-c resistance can be large for typical robust casing dimensions. This ratio could be at least 10:1 and could be as low as 3:1 while maintaining reasonable isolation between the inside of the outer conductor and the outside of the inner conductor.

To survive the hot spots in regions of poor thermal conductivity, the thick-walled down hole apparatus may be designed to withstand higher temperatures. One such design allows hot spot temperatures to increase to around 730 C, the Curie temperature of 0.5% carbon steel. Above this temperature the magnetic properties decline such that the impedance of the tubing or casing is reduced by a factor in the order of 10 or more. For this, an RF power source must be configured to be a constant current source.

To tailor the spatial distribution of the borehole heating to the spatial distribution of the thermal needs along the borehole, thick segments of different diameters of magnetic steel may be used, such that the surface impedance of the larger-diameter segments is less than the surface impedance for smaller-diameter segments. Alternatively, the chemical composition of the tubing, rod or casing may be varied along the length of the borehole, to control the variation in the permeability relationship with the conductor current and thereby modify the surface impedance characteristics. Materials can be added that increase or decrease the electromagnetic properties of the material. Another way to change the heating characteristics of magnetic materials is to anneal the material at high temperatures or to mechanically work the material.

To dynamically tailor the heating pattern to the actual heating needs, the frequency and/or amplitude of the RF power source may be varied electronically to increase or decrease the dissipation in one type of segment relative to the dissipation in other segments, so as to have the same dissipation or different dissipation between segments.

Alternatively, the dissipation of the heating elements may be controlled according to the temperature or pressure within the deposits, i.e., the heating pattern is tailored to the thermal processing needs. For this, the temperature can be controlled to obtain improved recovery.

Another version is designed to maintain a constant temperature by coating nickel on the interior surface of the outer conductor (casing or tubing) composed of 0.5% carbon steel, such as for use in rich oil shale sections that have poor thermal conductivity, as well in other formations as needed. Alternatively, the outer surface of the inner conductor can be coated with nickel. The nickel surface has a curie temperature of about 300 C, above which the magnetic properties diminish the surface impedance and thereby increase the conductivity of the skin effect region of the interior surface of the outer conductor. This limits the temperature of the heating source to near this value if a variable-frequency, constant-current source is used.

Another version uses inexpensive magnetic steel tubing that is coated with copper or aluminum on the inside of the casing or covered on the outside of the tubing. This lowers the surface resistance of the casing or tubing where heating is not required. By so doing, the use of more expensive non-magnetic stainless steel sections needed for reduced heating can be avoided while at the same time maintaining a robust structure.

Another version reduces costs while at the same time preserving the robust strength provided by a thick casing wall, by attaching to the inside of the casing or the outside of the tubing a thin-wall aluminum tube. The aluminum is attached by a swaging process. Alternatively, a variety of aluminum coating processes are commercially available. This permits the use of robust sections of magnetic steel while at the same time lowering the surface impedance where heat dissipation is not needed; thereby replacing more expensive non-magnetic sections of stainless steel.

Another version to reduce the surface impedance of inexpensive steel tubing is to form longitudinal slots and fill the slots with aluminum or other non-magnetic conducting material Another version tailors the geometry and materials of the tubular conductors to resist down-hole pressures and stresses without impairing the heating functions.

Another version tailors the dimensions and materials of the conductor to resist the stresses and temperatures at different positions along the borehole.

Another version where heat is transferred from the heater via physical contact with the formation controls the longitudinal (axial) flow of heat that is transferred by controlling the thermal conductivities of the casing, tubing or rods. The thermal conductivities are controlled by interposing heater material with higher or lower thermal conductivities or cross sections.

Another version where heat is transferred from the heater via physical contact with the formation, controls the longitudinal flow of heat (where heat is transferred by the thermal conductivity of the casing, tubing or rods) by decreasing or increasing the area of the transverse cross-section of the casing, tubing or rod.

Another objective is to control the transverse flow of heat into specific oil shale layers by installing thermal insulation between the casing, tubing or rod or the surrounding oil shale deposit.

Another objective is to control the transverse flow of heat away from the casing, tubing or rod into the deposit by controlling the black body radiation by varying the surface treatment of the casing, tubing or rods, so as to enhance or diminish the transverse heat flow away from the casing, tubing or rods, such as by oxidizing the various surfaces or by polishing the various surfaces to decrease the radiation of heat.

Another version uses inexpensive magnetic steel casing, tubing or rods that are covered with a thin cladding of copper or aluminum, or an interior tubing or rod that is covered with a thin cladding of copper or aluminum where heating is not required.

Another objective is to limit the axial or longitudinal flow of heat by the use of metal coated composite ceramic tubular inserts. A very thin metal coating reduces dramatically the highly thermally conducting cross section of the metal casing or tubing. The coating provides sufficient conductivity between the two thicker adjacent sections while at the same time radically reducing the thermal conductivity. Composite ceramics are used for body armor and are capable of withstanding severe impacts.

Comparison with Past Art

A major difference between the ICP and the RFT is that the ICP does not take into account all the electromagnetic phenomena that take place when current flows in ferromagnetic materials. As a consequence, the ICP tubular heaters must use extra thin heating wires, sheaths or conduits, which require expensive nickel/chromium/iron alloys that require swaging, electro-welding to assemble, and that require the use of a down-hole sliding contact within a thin walled conduit.

These and other differences are summarized in the following comparison:

| ICP | RF |
|---|---|
| Expensive nickel, iron, chromium alloys | Oil field available 0.5% carbon steel or cheap aluminum where appropriate |
| small diameter heating wires | robust thick walled tubing or large diameter rods oil field available .5% C steel |

-continued

| ICP | RF |
|---|---|
| Conduit to surround coaxial heater and to prevent collapse | conduit not needed, RFT robust enough |
| Thin walled sheath coaxially surrounds small heating elements | robust thick walled casing to coaxially surround tubing or pump rod |
| installation complex to interleave on site different heating sections. Special non standard couplings needed | Standard oil field installations at site to interleave different heating sections with commercially standard couplings |
| Skin depth greater or smaller than the diameter or wall thickness for ferromagnetic materials | skin depth always smaller than wall thickness for ferromagnetic materials |
| d-c and very low frequencies are used to control the waveforms | no d-c, low-to-higher frequencies are used to control the heating waveforms |
| reactive energy compensated at power line feed point | reactive energy recovered by RF power source |
| Non linear harmonics partially addressed | real and reactive energy in harmonic recovered by RF power source |
| energy dissipation controlled by selecting different materials and geometry and by frequency and nickel and copper claddings | Energy dissipation controlled by the frequency, magnetic materials geometry, conductor current level, copper or aluminum coatings |
| constant temperature versions uses curie point of nickel coating overlaying a wire | constant temperature version uses curie point of nickel thinly plated on ferromagnetic tubing/casing or servo control by thermocouple data |
| controlling dissipations between different sections of the heater with the application of a-c and d-c | dissipation between different sections is controlled by using different frequencies different magnetic properties per sections |
| Requires heater only with separate produce only wells | Heaters can be used as heaters only or as heater/producers |
| Thermal transfer by transverse radiation | Thermal transfer by transverse radiation or transverse and axial diffusion |

Controlling transverse transfer of heat by thermal insulation around a segment.

Controlling axial transfer of heat by low thermally conducting non-magnetic metals.

Controlling the heat dissipation of a rod, tubing or casing segment by varying the geometry, the chemical composition and heat treatment.

Controlling the relative heat dissipation between two different heater segments where each segment has different geometry, chemical composition or heat treatment and sequentially varying the amplitude and the frequency to preferentially heat one segment over the other.

Controlling the heat dissipation between two or more different segments having different geometry, chemical composition or heat treatment for each segment by simultaneously using two or more frequencies.

Controlling the heat dissipation between two or more different segments having different geometry, chemical composition or heat treatment for each segment by simultaneously using two or more frequencies that are harmonically related.

Controlling the corrosion of aluminum casing, tubing or rods by anodizing the surface.

Preventing the electrolytic corrosion of aluminum tubing or rods by blocking d-c current paths with a capacitor.

Need for RFT Skin Effects Methods

Conventional 60 or 400 Hz electrical power supplies are impractical for thick-walled or large-diameter configurations of the type shown in FIG. 3*b*. Because the d-c resistance of thick walled iron tubing is quite low, large currents are needed from low voltage power supplies to realize any meaning full dissipation. To illustrate, a major limitation is the amount of current and voltage that can be delivered down hole via commercially available components. Pump motor cable insulation and conductors can deliver up to 1000 amperes for 60 Hz power sources. Maximum cable voltage ranges up to a few thousand volts. Modern semiconductor power supplies are more efficient with circuit output voltages greater than a few 10s of volts.

Other available oil field components, such as thick-walled casing, tubing or rods, can be used in place of the thin walled sheaths or small diameter resistors such as illustrated in FIG. 3*a*. The resistivity of the steel is very low if measured at very low sub power (<<60 Hz) frequencies. For example, a 0.5% carbon steel oil well 4.5 inch casing has a 0.25-inch (6.5 mm) wall thickness. For this, a 1 meter length exhibits only $5\times10^{-4}$ ohms for 60 Hz excitation as measured from end to end; the corresponding value for stainless steel is $4.3\times10^{-4}$ ohms, and for aluminum is only $1.3\times10^{-5}$ ohms. For the carbon steel casing to deliver 1 kW per meter length, it requires a 60 Hz power supply to deliver 1500 amperes at 0.7 volts. To do this by conventional 60 Hz power supplies is not practical. And even with an output transformer, the limitation is the current carrying capacity of the interconnecting bus bars or cables, which can still be a problem.

This difficulty could be solved, if the resistance of the casing could be increased. One solution would be to use thinner-wall casing, but this would impair the robust nature of the thick wall casing. Another option would be to use higher resistivity materials, but these are costly, provide limited benefits and are often difficult to work.

Conventional design criteria for cables requires the current to substantially penetrate the cross section of the conductor. In the case of aluminum or copper conductors, the conductor is sized so that current penetrates nearly completely through conductor at lower frequencies. At higher frequencies, such as used for radio communications, a skin depth effect occurs that causes the current to flow with limited depth (called skin depth) on the surface of the conductor.

Traditionally, most design engineers chose frequencies and conductor sizes where the skin depth is greater than a sizeable portion of the radius.

However, commercially available, robust casing, tubing and rods can be used by decreasing in the effective wall thickness or skin depth. The skin depth is, approximately, inversely proportional to the square root of the frequency, provided that the skin depth is substantially less than the radius of the conductor. Skin depth, $\delta$, is defined as follows: $\delta=[\pi f\mu\sigma]^{-1/2}$m, where $\pi$ is 3.14, f is the frequency, and $\mu$ is the permeability that is equal to $\mu_r \times \mu_o$ (the relative permeability is $\mu_r$ times the permeability of free space, $\mu_o$, equal to approximately 1.2 $10^{-6)}$, $\sigma$ is the conductivity in mhos/m.

Controlling the skin effect permits the use of thick walled, robust, commercially available oil well tubing and casing. The RF heating design criteria allows the use of technology that is commercially available. Such variable frequency power supplies are also compatible with commercially available oil field components. Such power sources operate more efficiently with higher output voltages in the range from 50 to 100 V but not exceeding about 1500 V. The use of low output voltages leads to inefficient operation that requires high output current. The high output current will require large and inconvenient to use conductors.

The more practical option is to increase the frequency of the output from the power supply and use rods, tubing or casing that is ferromagnetic. If ferromagnetic materials are used, the magnetic fields and high magnetic permeability of the material causes a reduction in the depth of penetration of the surface current into the conductor. This increases the surface impedance of the tubing or rods and reduces the required current needed for a given dissipation.

Robust Issues

To meet different installation and operational requirements, the RFT heater can employ a wide variety of tube diameters, wall thickness and magnetic steels while maintaining the ability to supply large amounts of heat. For example, the best combination of tubing sizes and physical strength can be chosen from commercially available pipe sizes and materials. The following excerpts from a table, from I & S Independent Pipe and Supply Corporation, illustrate the standard pipe sizes that can be furnished for commercial and oil field applications, with schedule # 40 and schedule # 80 being most common.

| Pipe size | Outside diameter inches | # 40 wall thickness inches | # 80 wall thickness inches | # 160 wall thickness inches |
|---|---|---|---|---|
| 2 | 2.875 | .154 | .218 | .375 |
| 3 | 3.5 | .216 | .300 | .438 |
| 4 | 4.5 | .237 | .337 | .531 |
| 8 | 8.65 | .332 | .500 | .906 |

The pipes can be supplied using materials that have high yield points, in the order of 60,000 psi for carbon steels. Steel with lesser or greater yield point are available to meet other requirements, such as cost or corrosion.

These pipes can be purchase based on standards and specifications set forth by the ASTM, API and ANSI. Such practices increase the reliability and performance The oil field applications include production casing and tubing that are shipped, dropped on the drilling platform, connected by power casing tongs and suspended by slips in long 1000 feet strings into the borehole. The slips and tong have pipe-wrench like saw-tooth surfaces that bite into the pipe.

As such, these oil-field pipes, casing and tubing are considered to be very robust. The RFT heater is also robust because it uses these robust components. The design of the RFT heaters are based on the electromagnetic properties of actual oil well casing and tubing measurements, such as shown in FIG. 4.

Different applications of the RFT heater may require different designs. For example, in the case of Western oil shale, the oil shale may swell during heating and compresses the heater.

The robustness of different tubing can be assessed from the data in the table from the I& S Independent Pipe and Supply Corporation. From these data, the wall thickness of schedule, 40 and 80 pipes were analytically modeled as a function of the O.D. outside diameter of the pipe. On the basis of these data, the minimum wall thickness for robust use was to taken be one half of thickness for the schedule 40 for pipe O.D. diameters between 2 and 10 inches, such that:

For schedule 40 minimum robust wall thickness=$(4\times10^{-2}$ (4−(0.46)(O.D.)) inches Sandburg (2005/0006097) notes various studies on the effect of oil shale swelling into the borehole and crushing the conduit that surrounds the ICP heaters. For different heating and emplacement scenarios, he shows in his FIG. 54 that the maximum radial and circumferential stress to be in the range of 4,000 to 11,000 psi for different oil shale richness. In FIG. 57, he shows the maximum radial and collapse stress of a conduit to be in the range of 2,000 to 8,000 psi.

These stresses are well below the yield point of readily available carbon steels which have a yield stresses in the order of 60,000 psi and such data show that the more robust RFT heaters can be designed to cope with the swelling problem To further mitigate the swelling effects, the thicker casing would be emplaced near a swelling shale interval.

Surface Impedance Effects

To avoid failures, a more robust, thicker sheath or tubing can be used. For example, as is currently available 0.5% carbon steel production casing and tubing can be installed by methods currently being used in oil fields.

Surface impedance measurements as a function of the conductor current can be used to design the heater; and this impedance is defined as the ratio of the voltage drop along the surface of a conductor by the current flowing in the conductor FIG. 4 presents a plot of the surface impedance 31 and phase angle 32 for typical 2.5 to 3.5 inch casing for 60 Hz casing current 33. Note that the phase angle is in the order of 30 to 40 degrees for currents below 200 A.

To assess the interaction between the different parameters as in FIG. 4, a fixed value for the surface impedance 41 of $10^{-3}$ ohms with no inductive component at 10 Hz is assumed. To dissipate 1 kW/m, the current 43 and the voltage 44 are estimated as a function of frequency 42. The surface impedance 41 is expected to increase as the square root of the ratio the operating frequency 42 to the reference frequency of 10 Hz.

Figure 5:
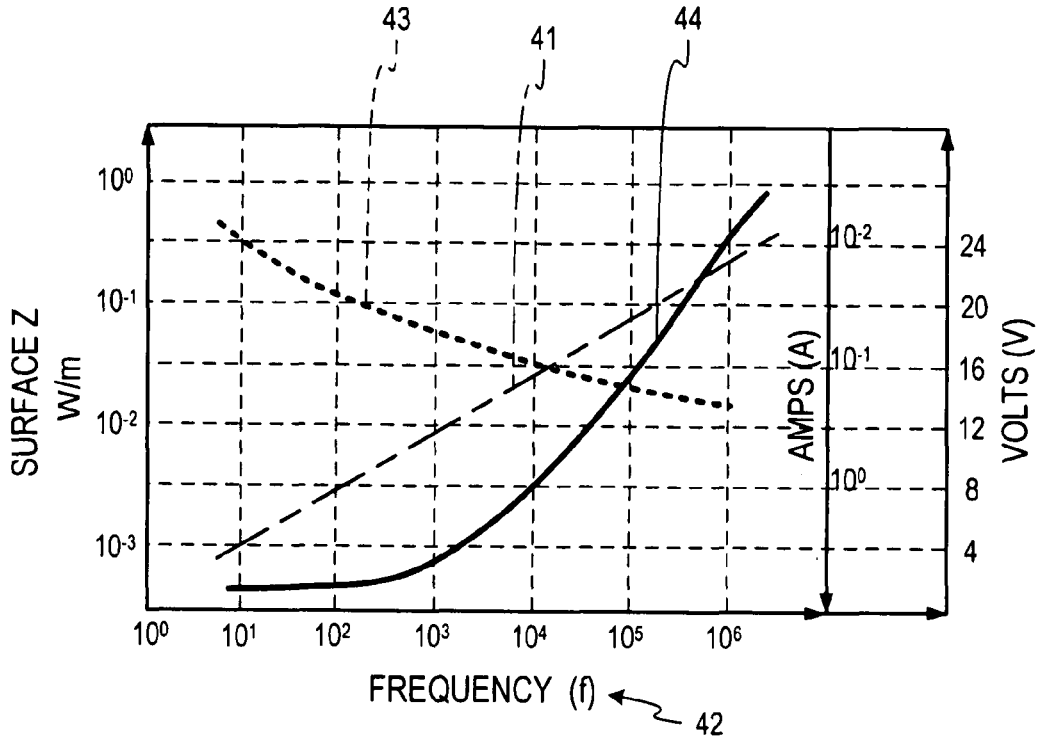
FIG. 5 shows the surface impedance, the applied voltage and current for a typical ferromagnetic oil well casing varies with the excitation frequency.

The effect of increasing the frequency 42 on the surface impedance 41, the output voltage per meter length of the tubing and current for a fixed dissipation of 1 kW/m is shown in FIG. 5. Note that, at 1000 Hz, the current is 330 A and voltage per meter is about 3.3 V/m. To estimate the voltage output requirements for the power source, the 3.3 volt/m voltage drop should be multiplied by the sum of the length of the heating segments. For example assume there are 100 heating segments, then the voltage output for the source would be 330 Volts for a current of 330 A. The voltage output would be total power dissipated in the tubing divided by the current.

More specifically, the data in FIG. 5 can be used to identify the operating parameters for a power supply to provide the required power dissipation.

Alternatively, the data could be used to design the heater to match the performance ranges of a given power source.

Figure 6:
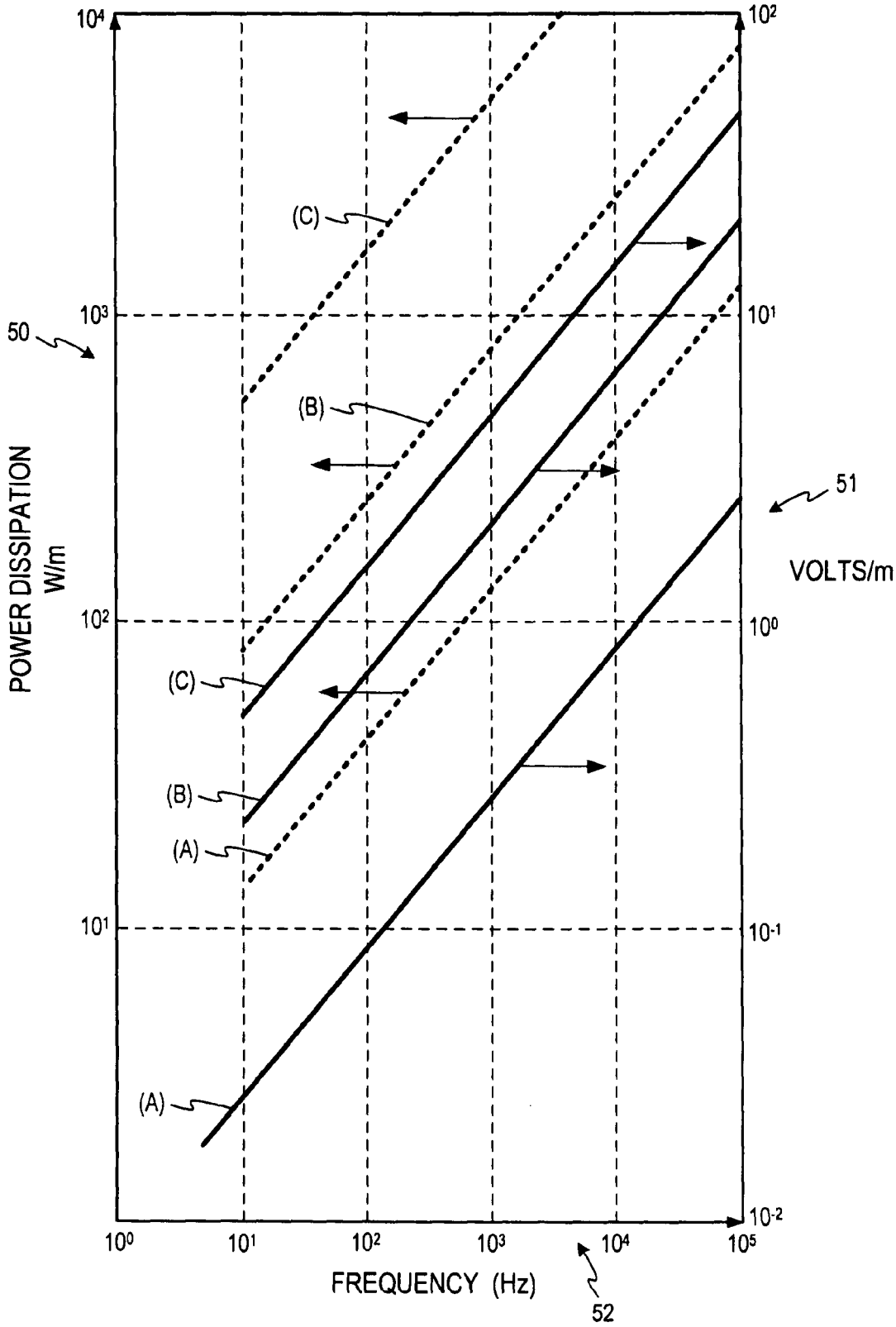
FIG. 6 shows the relationships between frequency, power dissipation, and voltage for different currents based on the data in FIG. 4.

FIG. 6 presents the power dissipation per meter 50 and the volts per meter 51 as a function of the frequency 52. Three values of casing currents were selected and the surface impedance for each current was estimated based on the data in FIG. 5. These are summarized in the table below.

| Case | Z real only ohms | Casing current amperes |
|---|---|---|
| A | $5 \times 10^{-4}$ | 50 |
| B | $1 \times 10^{-3}$ | 200 |
| C | $1 \times 10^{-3}$ | 500 |

From the above data the voltage per meter casing drops are calculated as a function of frequency for the three different casing currents. Also shown are the power dissipation per meter length for the three cases.

These data show that to obtain a 1 kW/meter dissipation for the 50 A current is only possible at the highest frequencies. On the other hand, the 1 kW/m dissipated can be realized using currents in the order of 200 A or more using frequencies less that 20 kHz. Thus the amplitude and frequency can be varied to control the input impedance presented to the power supply such that the currents and voltages are within reasonable operating ranges. The output voltages for a total voltage applied to the overall length of the heater, should be no less that 10 volts in order to assure high power supply efficiency and not more than several thousand volts, preferably no more than 1500V. There is no lower bound for the current and the limiting factor is the conductor size needed to carry the output current. However, a study of practical cables suggest an upper bound in the order of a few thousand A, preferably no more than 1500 A. The use of output transformers can be considered to confine the needed currents and voltages within the operating range of the power supply.

A related method could be use to tailor the design of the heater to fit the surface impedance properties to the output voltage, current and frequency range of a power source. For this, the acceptable ranges of frequency-dependent surface impedance would be identified. Next, data on the surface impedance properties as a function of current and frequency would be reviewed or developed for a number of likely casing materials and geometry. One or more of the more promising designs would be modified to improve the match. Such effort could include varying the magnetic properties and geometry, measuring the surface impedance properties as a function of the current and frequency and selecting the most promising design.

Embodiment for Heater and Product Collector

Figure 7:
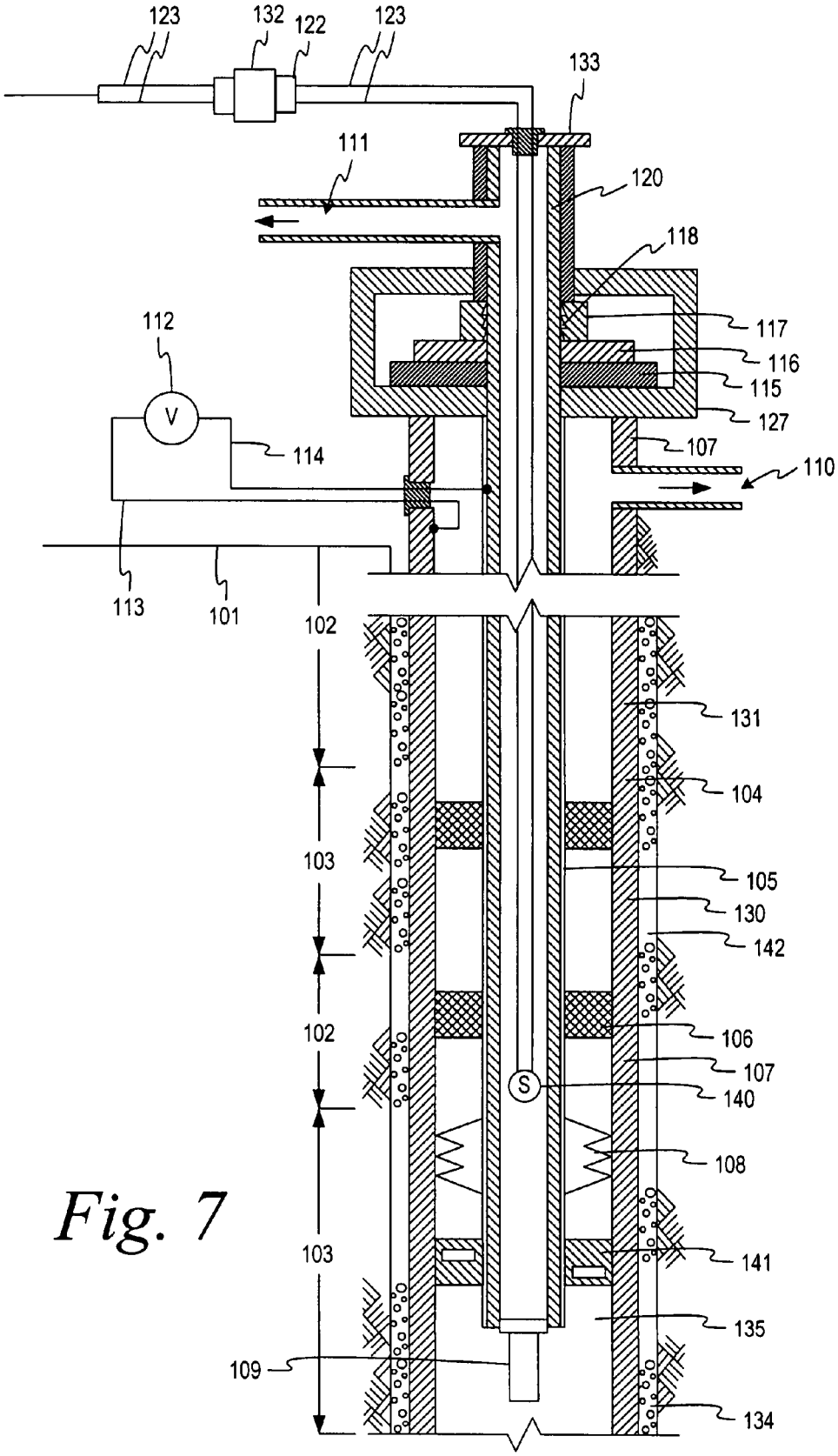
FIG. 7 illustrates a RFT heater installation that can both heat and recover product.

FIG. 7 illustrates a possible heater and product collector installation that uses components comparable to those found for oil wells. Not shown are the surface casing and surface equipment that would include a variable frequency 100 kW power source, a condenser to condense collected vapors into liquid and to clean up, incondensable gas collector and other above ground facilities. In this example, the casing is heated. Other examples may include heating the tubing or rods, as well as using all such conductors simultaneously to heat the deposit.

The objective of this configuration is to enhance the number of recovery options. One option might be to reduce the recovery time by heating around a producing well. This may reduce recovery time as opposed to a heater only, producer only configuration, assuming the same well spacing. It will generate product early on from shale near the well bore.

One option is where designated wells are producer-heaters and the remainder of the wells heaters only. The oil and gases are first produced near the heater-producer well. Heating will also enlarge the region of high permeability of spent shale around the heater producing well. By so doing, some product is recovered early on and the recovery of oil from shale near the heater can be more rapid because the enlarged high fluid permeability region near the producer heater well. The operating temperature of the producer-heating well may be controlled to avoid coking.

Another option is to use producer-heater wells only to reduce the time needed to recover the product.

To install the surface casing, the borehole to contain a 3 inch casing is formed and which is larger in diameter than the casing. When bottom depth is reached, the formation is logged to identify barren regions of high thermal conductivity and region of rich shale that have a lower thermal conductivity. Using these data, lengths of 3 inch casing are cut, magnetic steel sections are used to match the regions' rich shale locations; non-magnetic or reduced dissipation magnetic sections are then installed to match the lean or barren regions. The various sections are then progressively assembled according to the desired thermal properties along the borehole. When within a few feet of the bottom of the borehole, the top of the casing is attached to a surface support or hanger so as to suspend the casing to allow for changes in the length of the casing during heating.

If needed, the casing may be cemented to the formation as is traditionally done and swabbed out. The cement can be selected to dehydrate and lose strength during heating at temperature of 150-200 C., thereby forming a gas permeable annulus around the casing. To facilitate recovery of fluids into the lower region near the pump a gravel pack could be used to provide a downward flow path for fluids into a pump. In zones where the oil shale swells excessively, the casing adjacent such shale could be enlarged to resist collapse from the swelling of the richer shale Produced fluids might be collected via tiny slots cut into wall of the casing, in formations where accumulation of water in the annulus between the casing and the tubing can be avoided.

Other methods of production include the use of a larger borehole that has sufficient swelling space and a product collection rather to the lower part of the borehole. The larger diameter casing can enhance the radiated heat transfer.

The base of the tubing support shroud is installed on the top of the casing mount such that non-magnetic tubing can be lowered into the casing. Ceramic centralizers can be snapped on at intervals so as to prevent contact between the tubing and the casing. A gas lift or horse head pump designed for high temperature may be installed on the bottom of the tubing and used to remove liquids, especially water during the early stages of the heating.

An insulating disk is centered on the base of the shroud. A metal disk that supports the tubing grips or hanger is centered on the insulating disk and clamped to support the tubing string. The remainder of the shroud is assembled as shown in the figure. Connections are made to the power supply (not shown) as well as vapor condensers, oil cooler and gas clean-up subsystems. Current flows from the power supply down the tubing and into the casing via a tubing anchor that makes numerous molecular contact points with the casing to reduce the contact resistance.

To operate, voltage is applied between the tubing and the casing. As the formation is being heated, heat is diffused into the near bore region. Water vapors may first be produced as the cement and other compounds dehydrate. As the near borehole temperature increases to about 250 C, the kerogen begins to decompose and form inter connecting voids. As the heated zone further penetrates the formation, the more distant kerogen begins to be liquefied and vaporized. This back pressure moves the vapors into the borehole via the gravel pack (alternatively the swell space) and into lower portion near the pump. The vapor from the more distant and lower heated annular regions moves into progressively hotter regions. However, the temperature rise near the borehole is partly mitigated because the decomposition of oil shale is an endothermic reaction, and the vapors flowing in from the cooler, more distant portions tends to cool the formation near the borehole. Some swelling of the rich oil shale may occur but this is constrained by the gravel pack and casing or, alternatively, contained in swelling space formed within an enlarged borehole.

Other heating and production protocols can be developed to optimize the process. These could include pressurizing the borehole, and delaying the collection of vapors so to maintain the thermal diffusion conductivity of the nearby oil shale as long as possible.

To support the tubing grips, an insulating thick disk is centered on top of the base of the shroud. Tubing grips or a hanger clamp the tubing such that it supports the weight of the tubing string. The power is supplied via two insulated cables, one connected to the tubing and the other connected to the inner part of the casing.

FIG. 7 shows the surface of the earth 101, barren formations 102, rich oil shale 103, a magnetic steel casing 104, production tubing 105 of non-magnetic steel, a ceramic centralizer 106, a non-magnetic steel casing 107, a tubing anchor 108, a pump 109 and a borehole 121.

A thermally insulated pipe 110 carries hot vapors to a condenser and gas clean up subsystems not shown. A ceramic pipe electrical isolator 111, is used for liquid recovery from the pump and is electrically isolated from other subsystems.

An RF power source 112 is connected via cable 113 to the casing and surface casing to form an earth ground. The excitation cable 114 is connected to the tubing.

The tubing support subsystem contains surface support for insulation disks 115 and 116, a tubing grip support 117 and tubing grip 118. The tubing support subsystem is surrounded by a steel shroud 127 that is thermally insulated.

Barren zone thermal insulation on casing not shown is optional to equalize the heating between rich and lean zones where thick steel casing can transfer the heat axially. Thermal insulation is also applied to the surface casing (not shown), the shroud 127 and the casing near the surface to prevent heat losses and refluxing. A rat hole 135 is provided to accumulate liquids and drilling trash, and the gas lift pump 109 is used to recover the liquids.

A non-conducting high temperature ceramic tubing 120 is used to carry the fluids from the tubing support subsystem 116, 117, 118 to the ceramic electrical and thermal isolator tube 111 and to a pumping subsystem (not shown) access panel 133 and a non-onducting, high-temperature instrumentation pipe 122 that is surrounded by a radio frequency choke 132 to isolate the instrumentation apparatus from the RF voltages within the shroud 127. This choke can be formed from two laminated silicon steel "C" sections that have an inside width slightly larger than the diameter of a ceramic pipe or brushing 122 that surrounds temperature sensor cables 123. These are clamped together to form a continuous magnetic path such that it surrounds temperature sensor cables 123 that lead to one or more temperature sensors 140.

The magnetic steel region is in the oil shale 130 and the non-magnetic steel regions 131 are in the barren regions.

Other modifications are possible, to limit the heat losses near the surface. For example, a packer may be used to isolate the annulus near the surface such that the vapors are recovered via the conductive tubing 105.

Near the bottom, the tubing is electrically contacted by a tubing anchor 108 to the casing 104 to constrain the tubing and provide electrical continuity. Below the anchor, a packer 141 is used to seal the annulus between the tubing and the casing to prevent entry of liquids. It contains a valve that can be pressure activated to blow out any liquids. The casing portion 134 at the bottom is perforated to permit recovery of downward flowing fluids form the gravel pack 142.

This configuration uses the outer conductor as the single-point ground. As noted above, this requires the use electrical isolation techniques such as the use of isolation transformers, where the secondary is insulated from the primary. Ferromagnetic chokes and non-conducting tubing in suitable lengths can be used. Alternatively, the production tubing can be used as the single-point ground. To avoid multi-point ground problems, the surface equipment treatment of the casing ground is preferably used also.

Heater Only

Figure 8:
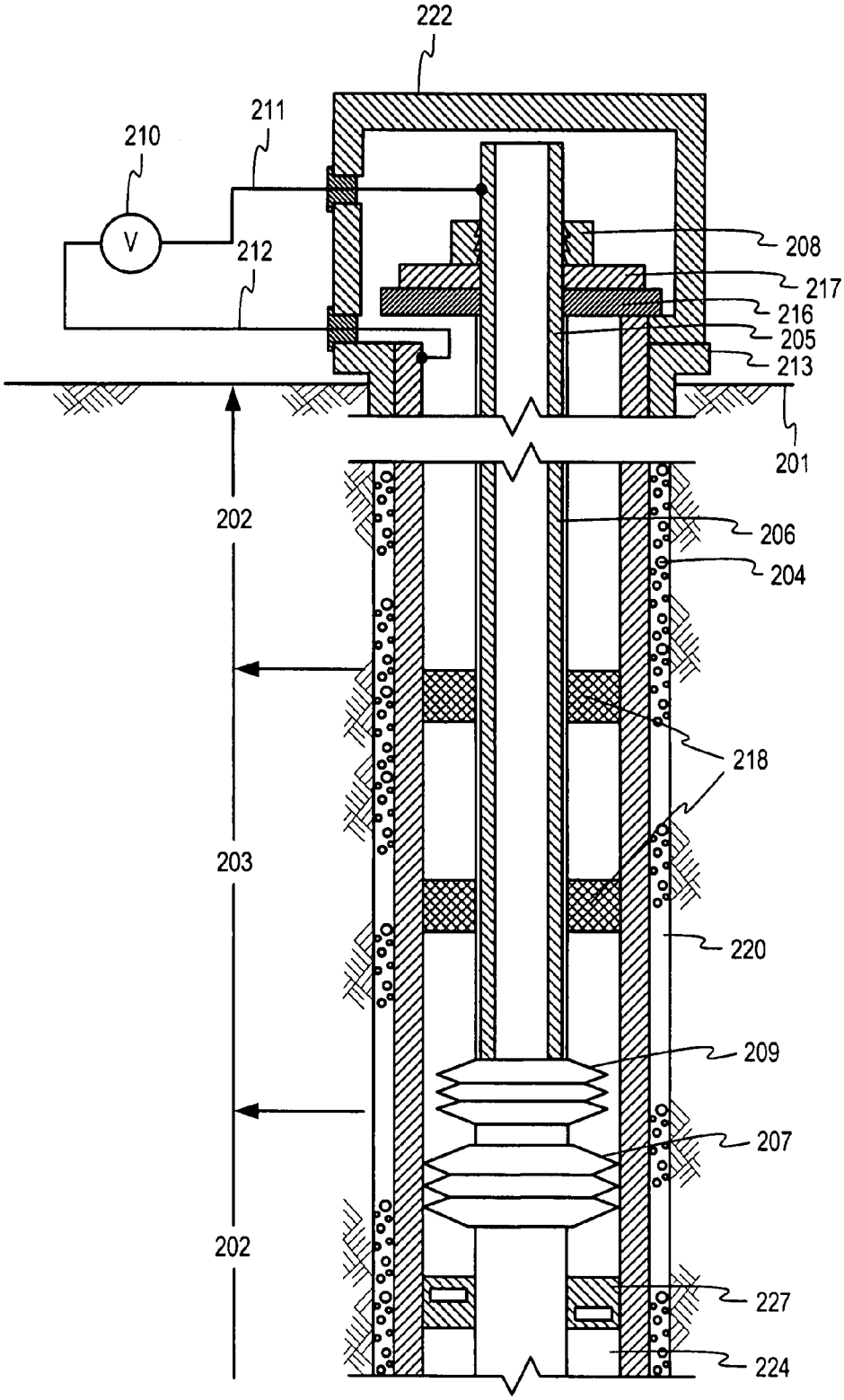
FIG. 8 illustrates and RFT installation that heats only.

FIG. 8 shows another robust installation designed solely to heat the formation. The arrangement is similar to FIG. 7, except that means to collect product have been omitted. For this arrangement, the center conductor can either be a tube or a rod. It can be either magnetic or non-magnetic, depending on the heat requirements. If magnetic, its dissipation can be larger than that which will occur for the casing. The heat from the center conductor is transferred by radiation to the casing and thence by additional radiation from the casing into the deposit. This can be enhanced by increasing the emissivity by oxidizing the surfaces of the steel where the heater does not contact the deposit. The casing can be non-magnetic steel. Under controlled circumstances, aluminum tubing that has treated surfaces to preclude corrosion and to enhance emissivity may be used.

Not shown in FIG. 8 are the above-ground facilities as well as the low loss electrical conductors needed to carry the power to the heater. The well is installed similar to that noted for FIG. 7 in a borehole that nearly contacts the casing or is enlarged for a swell space. The center conductor is preferably stretched to prevent curling of the center conductor because of uneven heating. This is done at the bottom of the hole by means of tubing anchor and expansion joint assembly. The borehole is drilled to a depth below the rich shale, and a packer is installed to seal off liquids.

Prior to heating, the casing may have to be cleaned with de-ionized water swabbed out to remove any conduction salts. The annulus region is preferably sealed to prevent ingress of water or other liquids that would cause short circuits between the case and the tubing. The annulus between the tubing and casing is preferably pressurized with a non-reactive gas, such as nitrogen.

Figure 9:
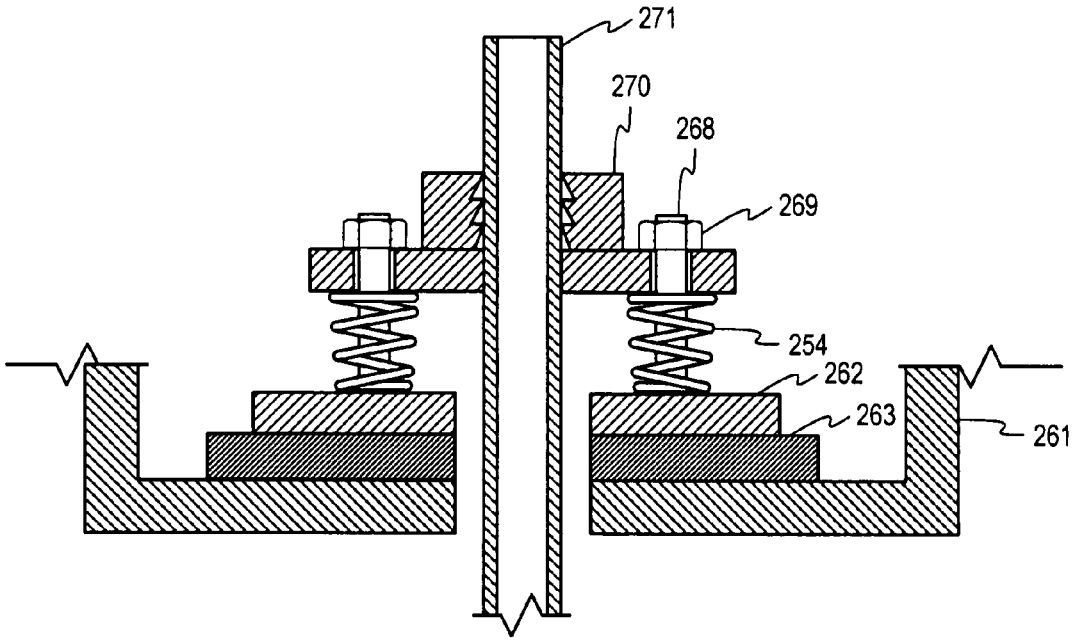
FIG. 9 illustrates how the inner conductor can be tensioned.

To avoid problems with sliding contacts, robust type wedge contacts that abrade the surface of the casing at the top and bottom of the rod/tubing can be used. To compensate for different length increases between the inner and outer conductors, FIG. 9 shows a method of maintaining tension by means of compression springs 254. Prior to installation of the tubing, the springs are compressed by tightening the nuts 269 on bolts 268 on compression plate 262. The upper portion of the tubing use grips 270 to constrain the tubing 271 to the spring plate. By loosening the nuts on the spring plate, the pre-compressed springs expand to create the desired tension so as to compensate for different expansion rates between the center conductor 271 and the outer conductor (casing/tubing). Also shown are the shroud 261, the insulation disk 263, and the compression disk 262.

FIG. 8 shows a surface 201, barren formations 202, rich shale 203, and a borehole Space 220. The electrical portion contains the non-magnetic outer conductor (tubing/casing) 204. The center conductor 205 includes the non magnetic section 206 and also heating magnetic sections.

The center conductor 205 is tensioned between the tubing anchor 207, the expansion joint 209 and the grips 208 during installation.

Power is applied by the RF power source 210 and energizes the casing via cable 211 and the tubing via cable 212.

Surface casing 213 is used to support the shroud assembly 219 and grout 214 is used to prevent gases from escaping.

The center conductor support subsystem consists of an insulation disk 216, a grip support 217, a grip 208 and isolated from the casing/tubing by ceramic centralizers 218. The center conductor is captured down hole by a tubing anchor 207 and expansion joint 209. Below the anchor a packer 227 is used to seal the annulus from the rat hole 224.

Both electrical and thermal insulation is applied to the shroud 222. Thermal insulation is applied to the surface casing 213 and may be used to prevent heat loss to barren zones by applying thermal insulation to the casing/tubing near such zones.

Some material cost savings are possible while at the same time providing means to measure the temperature at different points and using these data to control the heating rates so as to reduce the heat transfer into barren zones while at the same time not exceeding temperatures in excess of predetermined value, such as 360 C.

In this case, the inner conductor 205, the tubing, is replaced by aluminum tubing and the outer conductor 204, the casing, is composed of magnetic steel segments. Each of the outer coaxial magnetic steel segments are chosen to match the heating requirements of each layer of the deposit. For barren zones, the inner surface of the magnetic steel casing 204 could be coated with thin layer of aluminum or plated with a thin layer of chromium. And for rich layers that need a higher heating rate, the lining could be removed or no plating used.

Aluminum is also used to coat steel avoid. For this, the surface is treated, such as anodizing, preclude corrosion. Coating the inside or outside of the coaxial conductors with the aluminum will reduce the heat dissipation while at the same time avoiding corrosion.

Alternatively, as shown in FIG. 3*b*, a carbon steel casing 28 could be used that has a thin gap 30 that is perpendicular to the circumferential magnetic field 26. This slot acts like an air gap in a core of a transformer such that the overall permeability is reduced. For most situations, this will increase the skin depth and thereby reduce the surface impedance relative to that for a similar but unmodified magnetic steel casing. A series of very thin longitudinal gaps could be cut through the casing over short intervals such that an uncut bridge remains for strength. Then the gaps could be welded shut by non-magnetic welding material or filled with aluminum.

To control corrosion or contamination, especially for the aluminum tubing, the inner space between the tubing and the casing can pressurized with nitrogen to prevent ingress of fluids. This assures that the aluminum tubing or the thin aluminum or copper liner of some portions of the casing will not be corroded or contaminated A gas pressure controlled valve within the packer 227 shown in FIG. 8 can be forced open by over pressuring the annulus to drain any excess liquids into the rat hole.

To measure the down hole temperature, subsystems can be installed within the Inner surface of the tubing. For example, prior to installing the shroud 222, the stainless steel sheathed thermocouple cables can be fished into the tubing inner opening. The thermocouple wires must be isolated from the ground equipment by means of chokes similar to 132 in FIG. 7, isolation transformers or fiber optic links. Other temperature sensor subsystems can be used, such as those employing fiber optics, thermistors or temperature sending metals.

Energy Recovery RF Power Apparatus

Figure 10:
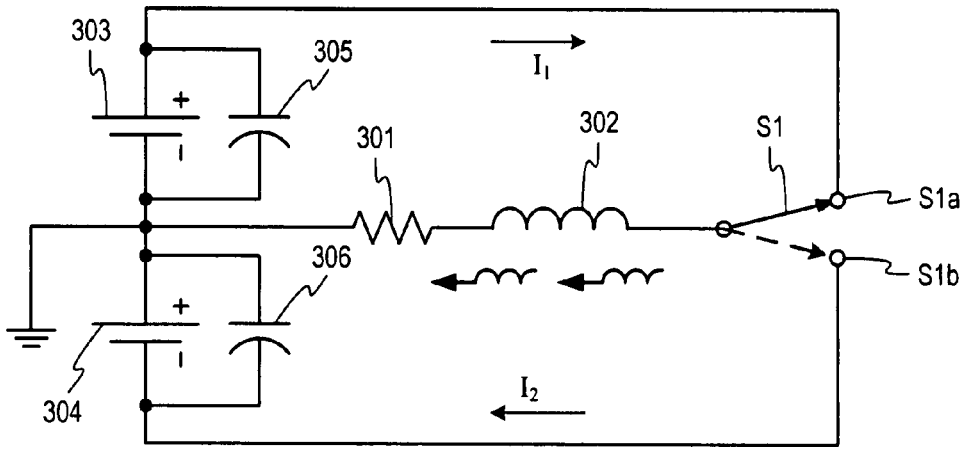
FIG. 10 is a simplified circuit diagram of an energy recovering switching circuit that applies a square wave to a load that contains an inductive reactance.

An energy recovering variable frequency power supply is best understood by referring to FIG. 10. This shows a switching power supply that generates a square voltage wave across a load. Here the load represented as a resistance 301 and an inductance 302 of the down hole input impedance between the tubing and casing. To start, this load is rapidly connected briefly to a positive terminal of a battery 303 by moving a switch S1 to engage a terminal S1*a*; and then as soon as the switch S1 is disengaged from the terminal S1*a*, the load is rapidly connected to the negative terminal of a second battery 304 by moving the switch S1 into engagement with a terminal S1*b*. However, the direction of the current $I_1$ does not change immediately within the load inductance 302. The inductance resists rapid changes in the current through it such that when the switch S1 is moved rapidly from terminal S1*a* to terminal S1*b*, the inductance forces the current to continue flowing in the same direction manner to charge the battery 304, thereby recovering the energy that was stored in the inductance. Shortly thereafter the current flow is reversed and flows around the $I_2$ loop to discharge the battery 304. In practice, the batteries can be replaced by large capacitors 305 and 306 whose discharge time in the operating circuit is long compared to the duration of one switching cycle.

The procedure is repeated with the switch S1 opening and closing the $I_1$ loop, so that the battery 303 is recharged by the stored energy in the inductive load.

If the switch S1 were just opened at terminal S1*a* and not connected almost instantaneously to the terminal S1*b*, the voltage across the inductance would rapidly rise and cause an arc over, thus wasting the stored energy. However, this rise time is limited by the stray capacitance in the circuit and switching transistors.

By periodically switching between the two terminals, a square wave is applied to the load. This arrangement recovers the reactive energy and also undissipated real energy and reactive energy in the harmonics that are created by the non-linear behavior of the permeability. These reactive energies are recovered and stored in the batteries 303 and 304. These batteries (or equivalent large capacitors) prevent the harmonics from causing power line interference that might occur if the battery/large capacitor circuit functions were omitted.

It may be desirable to limit the application of the very high frequency content of the square wave, since this might be more rapidly dissipated in the heater near the feed point. To avoid this, a series inductor, shunt capacitor low-pass filter can be interposed between the source and the load to reduce the rise time (and high frequency content) of the waveform applied to the deposit.

Figure 11:
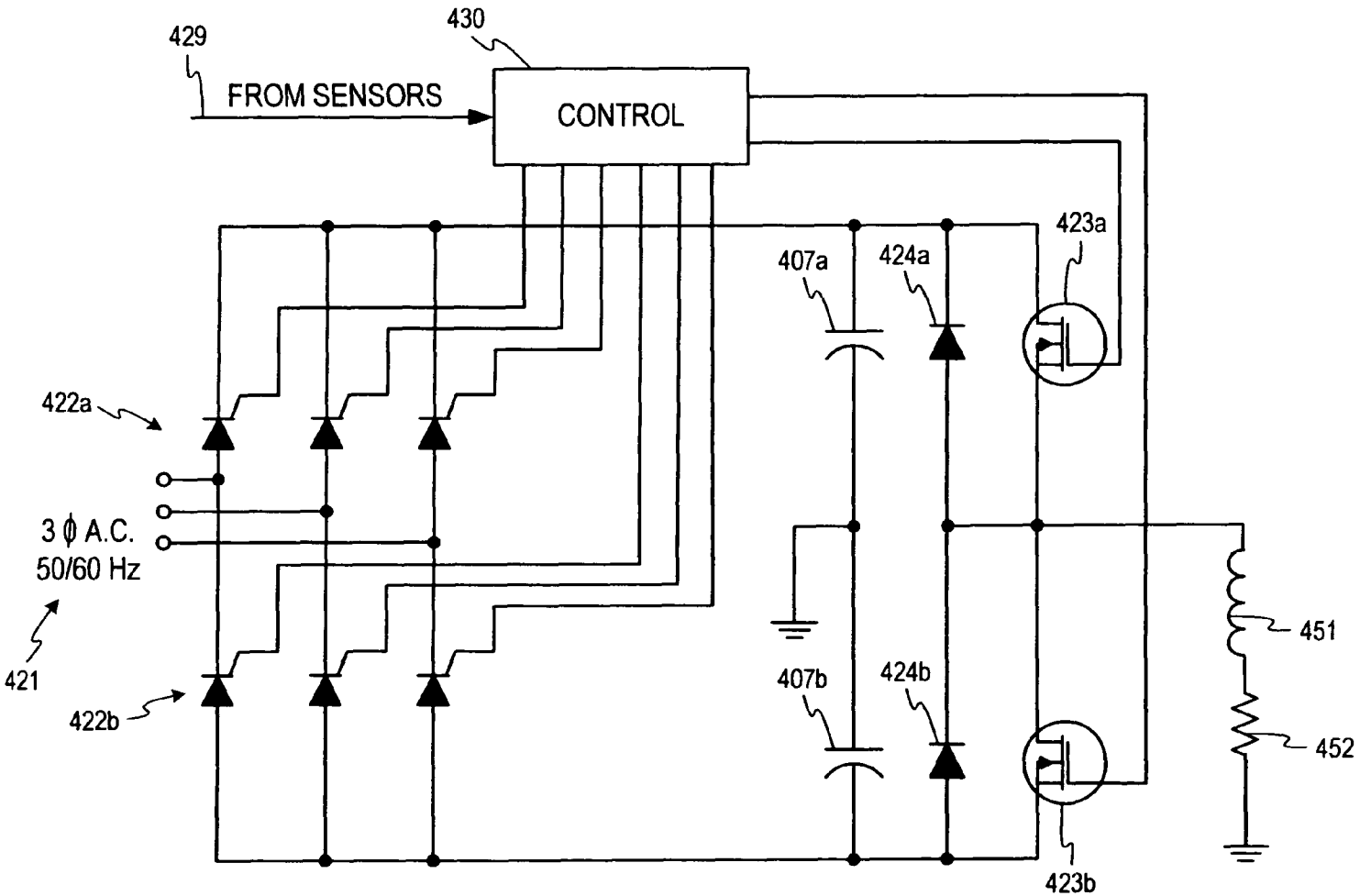
FIG. 11 is a functional circuit diagram of a square wave power source having a controllable amplitude and repetition frequency that recovers undissipated energy from ferromagnetic casing loads.

FIG. 11 illustrates some of the basic circuit details needed for the square wave exciter and energy recovery system. The three phase line power 421 is converted into d-c voltages across capacitors 407*a* and 407*b* by means of GTO (gated turn off) transistors 422*a* and 422*b*. By properly firing and turning on and off these devices, (as noted in Dorff 1993, Section 29), the d-c voltage can be varied to control the amplitude of the square wave output. Mosfets 423*a* and 423*b* in combination with reverse diodes 424*a* and 424*b* provide switching functions similar to the switch S1 in FIG. 10. Similar switching function can also be realized by IGBT (insulated gate bipolar transistors) or GTO devices.

In response to signals 429 from a variety of sensors, digital or analog, a control subsystem 430 provides on or off firing pulses to control the frequency or repetition rate for the square wave and also to control the d-c voltage that determines the amplitude of the square wave. The sensors can include downhole temperatures, pressures, output voltages, current and phase, safety action to prevent overload current or electrical shock and digital data from computers, such as to control the heating in response to the production rate of recovered product. By such means, most of the energy is expended in the resistive portion 452 of the load, and most of the energy stored in the load inductance 451 is recovered.

Figure 12:
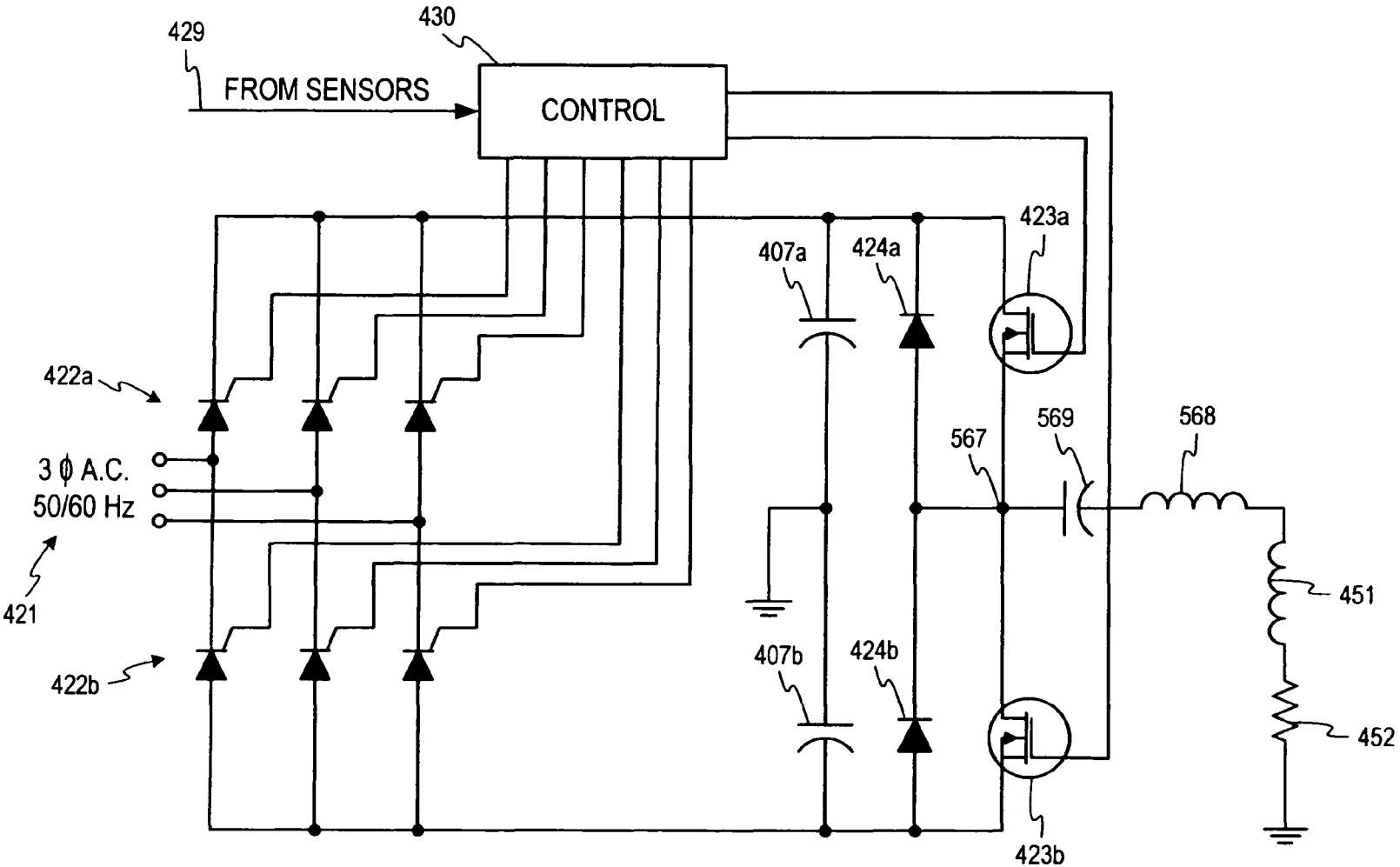
FIG. 12 is a functional circuit diagram of a sine wave power source having a controllable amplitude and frequency that recovers undissipated energy at the excitation frequency.

Another method of generating sine waves is shown in FIG. 12. This is more appropriate where the harmonic effects are small or not important and where higher frequencies are needed. Here a series resonant L-C circuit comprising an inductor 568 and a capacitor 569 is interposed between the output 567 of the square wave source and the down-hole load. By varying the frequency, the effect of the series tuning capacitor 569, the series tuning inductance 568 and the inductance 451 of the load is tuned out by changing the frequency such that the sum of the inductive reactive components equals the capacitive reactive component of the tuning capacitive component such that only a resistive load 452 is presented to the source. Assuming very low loss tuning inductors and capacitors, this assures that most of the power is delivered into the down hole load.

Variable capacitors or inductors could be used to avoid changing the frequency, but the geometry of such components may require mechanical movement. For high power levels, in the order of 10s of kW such component can be quite large. Mechanically changing the capacitance or inductance may be inconvenient because the load inductance varies with the load current. This can be mitigated by changing the frequency, such that the effect of a different load inductance is tuned out. This can be done automatically by measuring the phase angle $\Phi$ at the input point to capacitor 569 and using these data in a servo loop to vary the frequency in a direction that reduces the phase angle to a very small value.

A variable capacitor can also be used to block any d-c current flow that might occur at junction points between dissimilar metals. Similar blocking capacitors can be inserted, as illustrated in FIG. 11 at the load connection point at the surface.

Electronic Control of the Dissipation Between Different Segments

Electronic control of the division of power being dissipated in various segments near rich oil shale and near lean oil shale is made possible be the unusual non-linear properties of the ferromagnetic material, such as illustrated in FIG. 2*a*. Note that the shape of the magnetic permeability curve depends largely on the current over a wide frequency range, but not on the frequency. As a result the skin depth, as noted in equation (3) and related surface impedance equation (2), can be controlled by increasing or decreasing the frequency independent of the current flowing in the ferromagnetic tubular conductor. Hence the ratio of the surface impedances for two different frequencies is proportional to the square root of the ratio of two different frequencies, for the same current. This non-linear behavior can be exploited to shift the heating between rich and lean oil shale heating segments by electronically changing the frequency and using different rod, tubing or casing geometries which use the same material.

Figure 13:
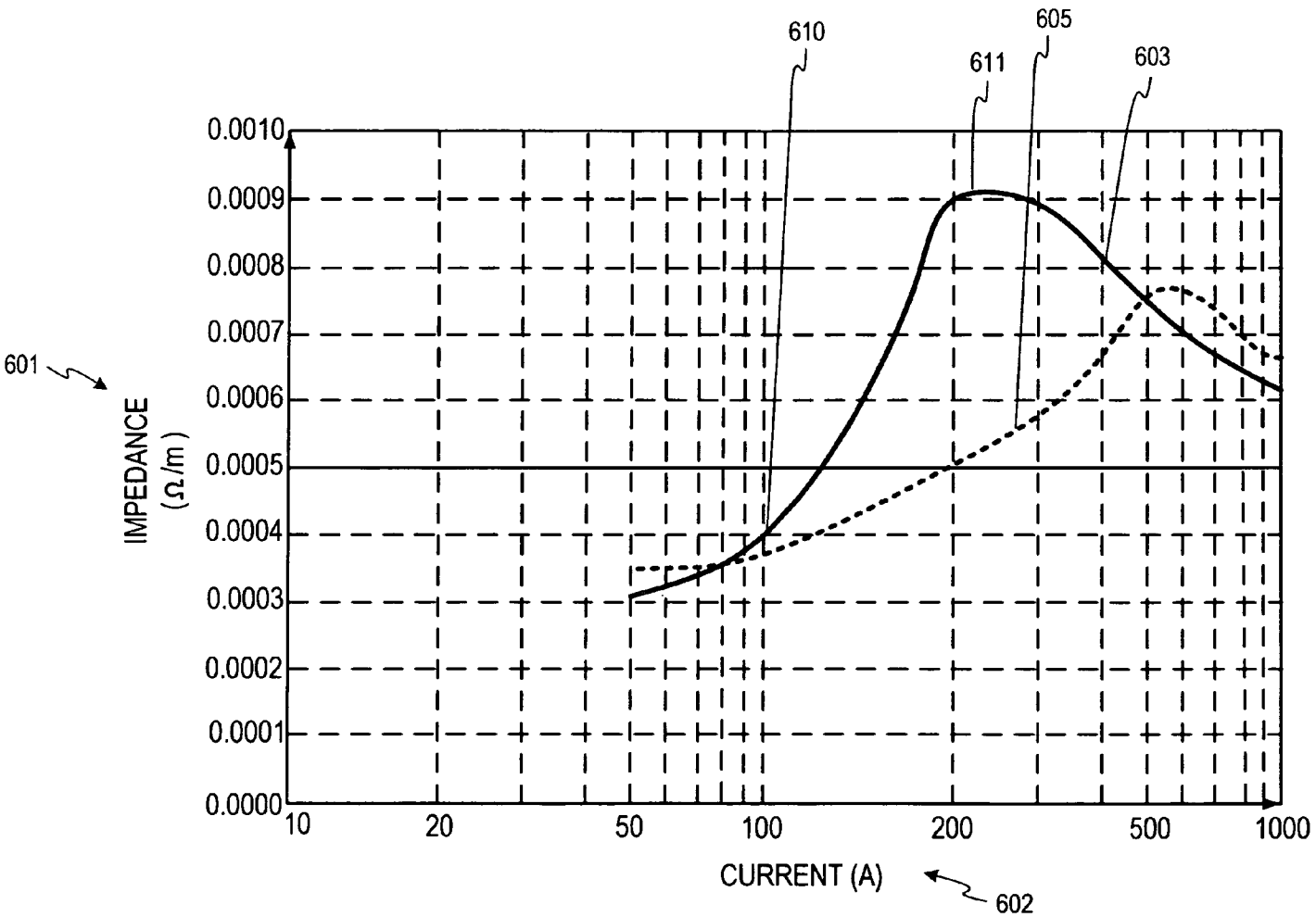
FIG. 13 shows a plot of the surface impedance for a typical ferromagnetic casing as a function of the casing current at different frequencies.

The surface impedance 601 is shown as a function of the casing current 602 in FIG. 13. Shown is the surface impedance 603 for 3.5-inch, 0.5% carbon steel casing vs. the casing current at 100 Hz. Also shown is the surface impedance 605 for a larger diameter, 0.5% carbon steel casing vs. the casing surface current at 100 Hz. Because the surface impedances of the casings are inversely proportional to the square root of the frequency, the surface impedance can be increased or decreased by changing the frequency without affecting the shapes of the curves 603 and 605 The frequency can be varied over wide ranges without markedly affecting the general shape of the surface impedance curve as a function of casing current.

To vary the relative heating rates between two segments along the borehole, the following three-step procedure is used:

1. Two or more different casing geometries and/or materials are selected, and the surface impedances as a function of casing current are compared. For any pair of impedances, note the current (a) where the difference (b) between the two surface impedances is the greatest and the current (c) where the difference (d) is the least.

2. Subtract (d) from (b) for each pair selected and choose the combination with the greatest difference for this step. Determine the power dissipation for current (a) and current (c) for the respective surface impedances.

3. To increase or decease the dissipation to the desired value, the frequency is increased by the square of the relative power variation needed such that: (new frequency)=(100 Hz)×((power needed)/(power of step 2 data)).

For example, using FIG. 13 data and for simplicity, assume the reactive power is zero and that both casings have the same $Z=3.5\times10^{-4}$ at 100 A (point 610) and $Z=9\times10^{-4}$ at 200 A $9\times10^{-4}$ for the 3.5 inch casing, and $4.5\times10^{-4}$ for 4.5 inch casing at 200 A (point 611). For this example the increase is power dissipation in the 3.5 inch is twice that for the larger casing at 200 A. However, the power dissipation range is only 3.5 to 35 watts/meter, far too low to be of interest. The relative dissipation can be changed, simply by varying the current from 100 A to 200 A. But the dissipations are too low. To increase the dissipation the surface impedance must be increased. If the frequency is increased by a factor of 100 to 10,000 Hz, the impedances will be increased by a factor of 10, thereby increasing the dissipation to 180 and 360 W/m respective for the larger and smaller casing.

To equalize the dissipation between the two segments, the current can be reduced to 100 A (610), where both segments exhibit a smaller difference in surface impedance.

To use this method, the power supply must be used as a current source and this can be done in the control subsystem by firing GTO to reduce or increase the output voltage such that the current remains at the desired value independent of the load impedance.

Thus to change the relative dissipation, the current is varied between two limits and to vary the overall dissipation, the frequency is varied.

Multiple Frequencies and Waveforms

The above illustrates how two different frequencies and amplitudes can be sequentially changed to control the heating rates of two different segments of the heater. Conversely two different frequencies can be simultaneously applied to control the heating rates of different segments. In this case, the magnetic fields from the lower frequency current would have greater penetration or skin depth into a given tubing or casing geometry and related magnetic characteristics. This occurs because the skin depth is inversely proportional to the square root of the frequency. By so doing the lower frequency current will have greater control over the permeability, the surface impedance and the resulting dissipation of heat within each type of casing or tubing.

As illustrated in FIG. 2*a*, the relative permeability increases and wanes as a function of the magnetizing force, H, and that H is proportional to the current. By using different geometries and magnetic characteristics for different tubing or casing segments, the heating rates between segments can be controlled by the amplitude and frequency of the lower frequency component. To minimize the generation of undesired nonlinear components, the higher frequency component should be a harmonic of the frequency of the lower component. For example assume the lower frequency is 1 kHz, the higher frequency components could be 10, 11, 12, 13, etc. kHz components. The phase of each harmonic component should be such that the zero crossings (where the amplitude is near zero) should preferably be the same for both the fundamental and the harmonics. However, the frequencies do not have to be harmonically related assuming the nonlinear components are tractable.

The waveforms do not have to be sinusoidal, and a preferred waveform could be a square wave for the either the low frequency or high frequency components or for both components. The reason is that currently available IGBT transistors can switch very rapidly and are widely used for switching applications. In this case, the frequency is defined as the repetition rate of the waveform. Further, the square wave conduction circuit of FIG. 10, allows the current to flow into an inductive and nonlinear load and recover the undissipated energy.

Figure 14:
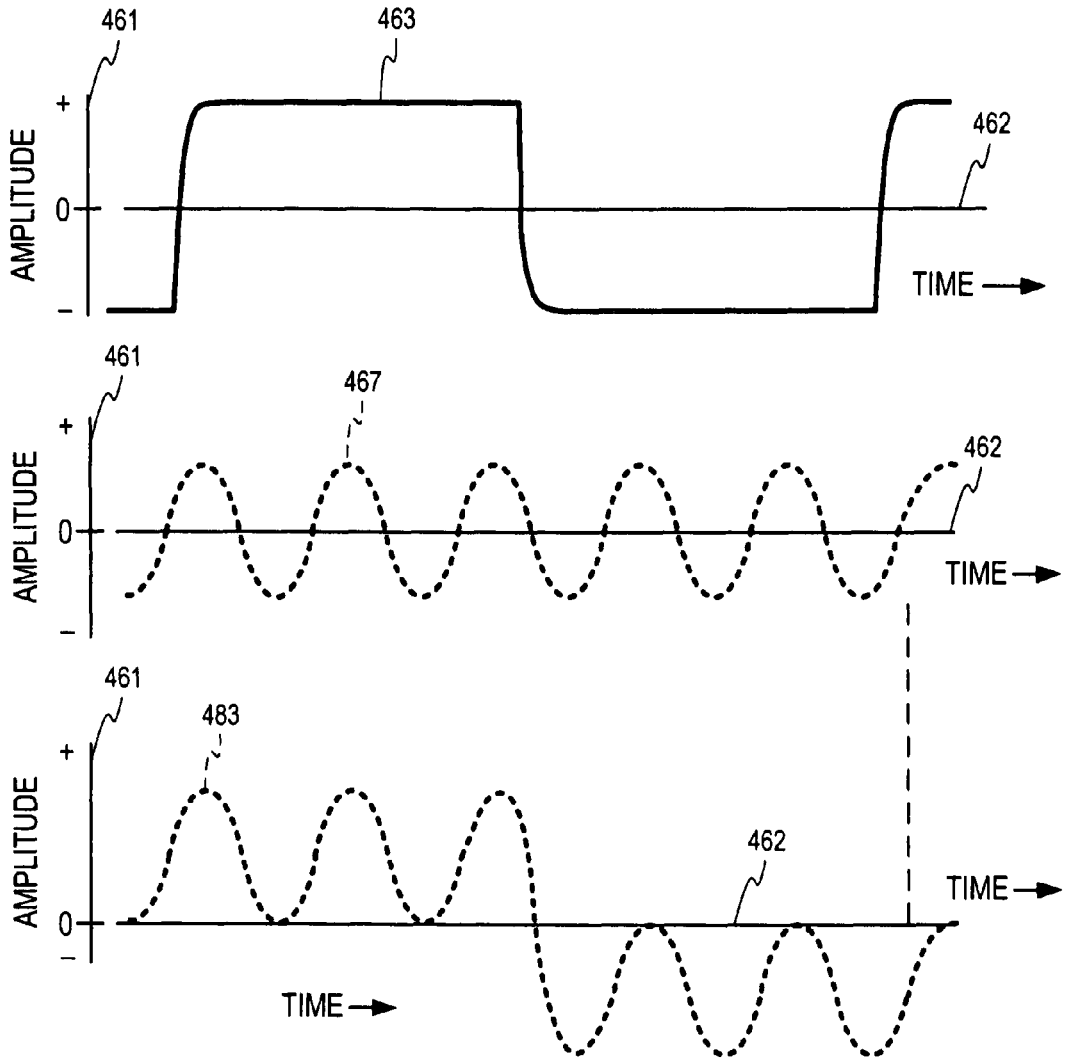
FIG. 14 illustrates how two different waveforms, each with different repetition rate, can be combined into a composite waveform to selectively control heating rates.

This can be done by using the a low frequency square wave circuit of FIG. 11; and as shown in FIG. 14, the low frequency square wave 463 as a function of time 462 and amplitude 461. Similarly the output 467 of the sine wave circuit is shown as a function of time 462. The sinusoidal waveform and the square wave form can be combined into waveform 483.

The two wave forms can be combined by a summing step to produce waveform 483 shown in FIG. 14. To avoid interaction between sources, a diplexer concept (Macchiarella 2006) can be used where each source is combined or summed via band limited filters. In this case, the high frequency source output would be connected through a high pass filter that rejects the frequency components from the low frequency source. A similar procedure would be used for the low frequency source, except a low pass filter would be used that rejects the frequency of the high pass source.

Other Designs to Vary the Dissipation Between Segments

Other configurations can be used to obtain similar or improved relative heating control by the current. For example in FIG. 2*b* a longitudinal slot 31 in the casing 28 can be cut to suppress the variation in the surface impedance. Another option is to fill the slot with a material, such as might be filled with non-magnetic welding material. Another option is to form a slot and weld transverse rods or wires of either magnetic material or non-magnetic material across the slots. The differences between the two ferromagnetic properties of each of the casing material can be exploited. These may be substantially different than the data suggested in FIG. 13 and provide increased ranges of control and different values of surface impedances. Variations in the ferromagnetic properties or conductivities due to different manufacturing and heat treatments may either enhance or degrade the properties shown in FIG. 13, and therefore will require quality control measures, and/or a specialized feedback mechanism that detects and compensates for the differences.

Thermal Flow Issues

Heat can be transferred by several methods: conduction or diffusion, convection and radiation. A convenient method for some of the examples discussed here is by radiant heat transfer wherein the heater is suspended within an enlarged borehole. The suspension method may be preferable, owing to the difficulty of making firm contact throughout the heater run with the formation and limiting the axial temperature range of the hotter temperature radiating section.

Another method is by thermal conduction where the heater firmly contacts the surrounding media. In either case, different treatments are needed as well as different heating strategies and completion techniques.

For example, consider the case where the heater wall is cemented to the deposit. In this case, the heat could be transferred by thermal conduction in a radial or transverse direction into the deposit and up and down axially or longitudinally by thermal conduction within the casing or tubing. For example, the wall thickness of typical casing, is in the order of 20 to 60 mm, and the thermal conductivity of 0.5% carbon steel is less than that for aluminum and more than that for stainless steel. Further the thermal conductivity of most oil shale is substantially less than the aforementioned values. These data suggest that substantial amounts of heat could flow axially up or down the heater conductors from a hot section of the casing or tubing into cooler sections.

It may be desirable to limit further the axial flow of heat by inserting low thermally conducting metallic sections with thin walls. A more effective thermal block would be to insert a composite ceramic tube that has very thin copper plated surfaces and plated end surfaces to maintain electrical contact with the conducting end of the casing or tubing. The thermal conductivities in W/m-C of various metals and alloys are as follows: copper, 287 to 386; aluminum, 121-189; brass, 119; nickel, 99; iron, 55-71; steel, 26-63; nichrome, 12; stainless steels, 10-19.

Where radiation effects are suppressed, such as by direct contact with the deposit, the axial flow of heat can be enhanced by increasing the transverse cross section of the casing, or suppressed by reducing it. Similarly, the axial flow can be enhanced by using materials with high thermal conductivity, such as aluminum or suppressed by using low thermal conductivity stainless steels. Such treatment could lead to equalizing the temperature of the casing between thermally different parts of the formations being so heated.

However, where the diameter of the borehole is substantially larger than casing, tubing or conduit and where these are suspended in a borehole, radiant heating transfer dominates in this annulus space. For example, according to Stephan's Law about 1000 watts/m of heat can radiate from 3.5 inch casing for casing temperatures in excess of about 200 C. Above this value, nearly all of the heat will be radiated and only a small fraction transferred axially. As a consequence, axial up and down heat flow is suppressed.

There is some evidence that certain minerals, such as silicon are partially transparent to some portions of the infrared radiation spectrum. If this is the case, additional transverse heat flow could take place that would be expected based on thermal diffusion concepts.

Radiation effects are a function of how the surface of the casing is treated. For example, oxidizing the surface of steel enhances the radiation while polishing the surface suppresses the effect.

Alternatively, radiation effects as well a thermal conduction effects into the deposit can be suppressed by wrapping thermal insulation around the casing. If carefully designed, this technique could reduce loss of energy in unproductive formations. Where the heaters are in direct contact with the deposit, this method would tend to equalize the casing temperatures. Where radiant heating is used, the introduction of such insulation could increase the temperature of the heater. In the case of a magnetic steel heater, the temperature could reach the curies point of 730 C and remain at this value if a constant current source is used.

Electromagnetic Environmental Considerations

These include electrical shock safety, corrosion and power line quality. The stove-top cal-rod heaters used today employ a heating filament surrounded by and insulating powder and a stainless steel sheath. Typically for electrical safety reasons the sheath is not connected to the electrical circuits, such that two isolated power connection terminals are used one for each end of the heating filament. This is not the case for the ICP apparatus, where the deep end of the filament or heating rod is connected at the bottom of the hole to the sheath. For the d-c or low frequencies being used, a d-c potential exists between the bottom of the hole and metal objects on the surface of the earth. This voltage is determined by the ratio of the resistance of the sheath to the resistance of the heating filament or rod. Depending on the actual circuit and contact position, it could be in the order of few percent of the voltage applied to the center conductor at the surface. This voltage, especially the d-c voltage and resulting current could enhance the corrosion rates of metallic equipment on the surface as well as those down hole.

In the case of the RFT, almost all of the electrical currents are contained within the casing or tubing and therefore pose no such corrosion problems. In addition, the whatever leakage of fields occurs, the frequency of these fields is very high; and since corrosion effects are inversely proportional to the frequency, in the case of aluminum, the surface can be treated to prevent corrosion.

In a coaxial arrangement, where aluminum tubing might be used in combination with a steel casing, the contact points at the base and top might create some dissimilar metallic contacts that could generate d-c currents. However, these can be mitigated by inserting a condenser in the current pathway at the power supply terminal as illustrated in FIG. 11 The value for this can be chosen so as not to block the high frequency current, while at the same time preventing the flow of d-c loop currents through the tubing and casing.

The ICP system makes no provision to mitigate the effects of harmonics being injected into the power line, especially if a transformer is used to supply 60 Hz power to the heater. However, harmonic energy can be generated by the non-linear response where ferromagnetic materials are used, especially where the permeability is varied over an appreciable range. Even if the reactive power of the fundamental of the applied power is compensated by either a static or active devise that supplies leading current, the harmonic energy could be still be injected into the grid. Such harmonics can cause a variety of problems and standard to cope with such problems are described standard IEEE 519.

Measured Data for Reservoir Analyses

Advanced digital processing can be used not only to design the heater, but can be used to help develop the most effective recovery methods. One such program, STARS is offered commercially (anon. 2000) by Computer Modeling Group Limited in Calgary Alberta. Data inputs for such digital processors includes the following: The thermal/physical properties of the oil shale as a function of temperature, kinetics of pyrolysis, permeability development, heating rate, coking effects. Much of such data has already been developed (reference Bridges 1981, Bridges 1982a, and Bridges 1992b, Baker-Jarvis 1984). Laboratory methods are described in these references to measure such parameters in small laboratory reactors.

Characterizing the Deposit

The deposit has to be characterized to determine the rich and lean zones to tailor the heating techniques to obtain the highest yield with the least amount of energy. Standard oil well logging, was well as core analyses, can be considered.

The spatial distribution of the thermal properties can be assessed by measuring the dielectric constant of the shale along the borehole. Existing technology may be available to make this type of measurement. Assuming existing apparatus is not available, this should be done over a large bandwidth from low frequencies to a high enough frequencies where the dielectric displacement current substantially exceeds the conduction current (loss tangent>1).

Note that the thermal conductivity is related to the electrical conductivity and that these electrical data can be correlated with actual thermal conductivity data on oil shale samples. Using dielectric methods noted in Bridges 1982a, dielectric parameters of oil shale can be correlated with thermal measurement made on similar samples.

Measurement of Electrical Properties of Magnetic Casing

The magnetic properties of a given type of steel can be expected to vary somewhat from batch to batch. For quality control and initial design purposes, the surface impedance of the casing, tubing or rods should be measured as a function of frequency, current and temperature.

This can be done by measuring the surface impedance of a one-meter length of casing, tubing or rod. The equipment needed for this could include 1 kW RF source that can generate frequencies over a few kHz to 50 kHz range, a set of transformers to match the power from 50 ohm RF source to the impedance offered by the test arrangement.

Two coaxial test jigs are needed. One to measure the surface impedance on the outer surface of a rod or small tubing that might be used as the inner conductor. For this the sample is coaxially located within a one-meter long larger diameter tube constructed from aluminum or copper. The distal end of the inner conductor test sample is short circuited via metal disk that symmetrically connects the distal end of the sample to the outer copper tube conductor. Tests are conducted by measuring the input impedance as a function of current and frequency. Calibration methods can be employed to compensate for lead inductances and other artifacts (see Stroemich 1990 for alternative methods).

To measure the surface impedance of the inside of the casing, the casing is substituted for the copper tube and a copper tube in substituted for the inner conductors.

Other Embodiments

This invention can be configured to heat via thermal diffusion other unconventional resources, such as heavy oil, oil sands, tar sands, oil impregnated diatomaceous earth deposits or other bitumen accumulations. For these deposits, much lower temperatures can be used, often less than 150 C. This permits the use of commercially available armored cables; such cables are currently used to supply power to down hole electric pumps. This allows the RFT heaters to be emplaced at greater depths.

For example, the heat, from a deeply emplaced RFT heater could be transported further into the deposit by thermal convection, either by hot water or steam. In the case of thick oil sand deposits, the RFT heaters could be emplaced horizontally to heat and mobilize the oil in the deposit. The heated oil with lower viscosity could be recovered in another horizontal well. This would parallel the heater and would be emplace well below the heater. Also the oil could be recovered by several other different methods, such as gravity drive or hot water floods via either horizontal or vertical wells, depending on the deposit.

Large unconventional oil deposits exist, but are not easily recovered using currently available technology, such as steam. Some 20 billion barrels of heavy oil are in place in California because these are too deep or too thin to be recovered by steam. Some 20 billion barrels of heavy oil in Alaska are not suitable because steam and hot water or steam cannot be used because permafrost problems. Production of some 100s of billions of barrels of heavy oil in Canada is being curbed because of environmental concerns, such as $CO_2$ emissions.

This invention can be configured to heat via thermal diffusion other unconventional resources, such as heavy oil, oil sands, tar sands, oil impregnated diatomaceous earth deposits or other bitumen accumulations. All of these deposits could be heated by thermal diffusion over time to temperatures capable of pyrolysis the hydrocarbon material into gases, liquids and residual char. RFT heaters can be installed in a fashion similar to those noted for the oil shale examples. Depending on the deposit, the heaters could be installed vertically or horizontally. The heaters could be used separately and the produced liquids and gases collected by adjacent vertical or horizontal production wells. Alternatively, the resource could be heated and the product collected by the combined heater-producer installation as discussed earlier. The advantage of pyrolysis is that high quality products can be recovered that require little upgrading. Another issue is that that heating to such high temperature requires a long time and to do this without losing to much heat to adjacent barren formations requires a very large deposit having a small surface to volume ratio.

The fuel from many of these unconventional deposits can be recovered by heating the deposit to low temperatures that are just sufficient to mobilize the viscous oil or bitumen, such that the heated oil could be collected by other methods. Such methods are well known and include gravity drive, hot water floods, steam floods, cyclic steam stimulation, CSS, and steam assisted gravity drive, SAGD. The RFT heaters can be used to supply the necessary heat in situ to implement these methods. The use of the RFT heaters is most attractive where conventional methods do not work well, or where serious environmental issue exist, such polluted water and $CO_2$ emissions.

For many of the aforementioned deposits, much lower temperatures can be used, often less than 200 C. This permits the use of commercially available armored cables; packers or pumps.

Large amounts of heat are used in currently available heavy oil extraction processes that use hot water or steam. However the single RFT heater down hole assembly must be configured to supply more energy for hot water or steam floods, much more than a single 1 kW/m to 3 kW/m, oil-shale heater.

The use of armored pump motor cable can be used to transport electrical power 100*s* of meters down through the overburden to RFT heaters located near or within the pay zone. Existing pump-motor armored cable design and existing power sources can be modified to supply power into the mega watt level.

The RFT heating systems are capable of providing even greater power, at the 10 mega watt level, because the power delivery method and heater are both very robust. To supply power at the mega-watt level, the low dissipation methods to deliver power through the overburden noted for the shale oil RFT can be used. These can use large diameter aluminum casing, ferromagnetic steel casing with aluminum filled slots, or ferromagnetic steels with the inner side coated with aluminum. Such arrangements can deliver more current than conventional cables because of the larger size conductors and wider spacing. Low dissipation RFT conductors that pass through the barren zones to deliver power to the high dissipation RFT heater in the pay zone. These can be large and can be designed to withstand the higher temperatures.

The RFT can also be configured to supply in situ the heat needed for hot water flooding or steam injection in deep deposits where the thermal losses along the casing preclude the use of steam. Examples of such deposits exist in California or in Alaska, where heat losses along a casing a great depth precludes the use of conventional hot water or steam injection. For example, a small diameter RFT heater could be coaxially centered at a deep location in the casing such that injection water flows around it. The casing and the RFT could be emplaced in either vertical or horizontal wells. It could be located in formations near the deposit or adjacent to the deposit. Within the RFT heater, the annular space between the outer and inner tubing or rod must be sealed off and filled with gas or high temperature oil. The advantage of this design over the conventional tubular resistance heater is that it is robust, has a large heat transfer area and is easier to install.

Hot Water Floods

The concept here envisions a conventional oil well emplaced in a deep heavy oil deposit, too deep for conventional steam flooding. It is designed to inject hot water into the deposit, or after time, to be easily modified into a conventional production well. This well could be part of a multi well water or steam flood process. It is further envisioned that the hot oil or steam would reduce the viscosity of the oil near the injection well. This would improve the injectivity by reducing the pressure needed to inject a given amount of fluid. These injected fluids also force some of the cooler oil into the into one or more producing wells. After some time, the flow might be reversed so that the injection well become a producer well simply by withdrawing the heating and installing a pump.

One advantage of the hot water injection over steam floods is that steam tends to rise and form a steam filled cavity near the top of the heated zone.

For this, a long thin RFT heater could be lowered into the casing for the purpose of heating the water that is to be injected into the oil saturated formation. Depending on the heating requirements, the length of the RFT heating tool could be in the order of 10s of meters in length, or even more, so as to assure good heat transfer into the water without excessively heating the surface of the tool. As such, a portion or all of the tool could in barren formation, and some of the heat from the RFT heating tool transferred into the barren formation. Over a few months, the amount of heat loss into the barren formation is limited by thermal diffusion. The heat lost into the barren decreases in time to a small value relative to the heat injected into the formation by convection.

Prior to installation, a computer aided reservoir study is desirable to determine long term injection water and electrical power requirements. To achieve this, a number of variable can be considered, these include the power dissipation by the RFT heating tool, the temperature, and the injectivity (flow rate per unit bottom hole pressure). The injectivity is a function of the spatial distribution of relative permeability of the formation that surrounds the borehole; and this distribution is a function of the viscosity, oil/water ratio, past history and other variables.

Figure 15A:
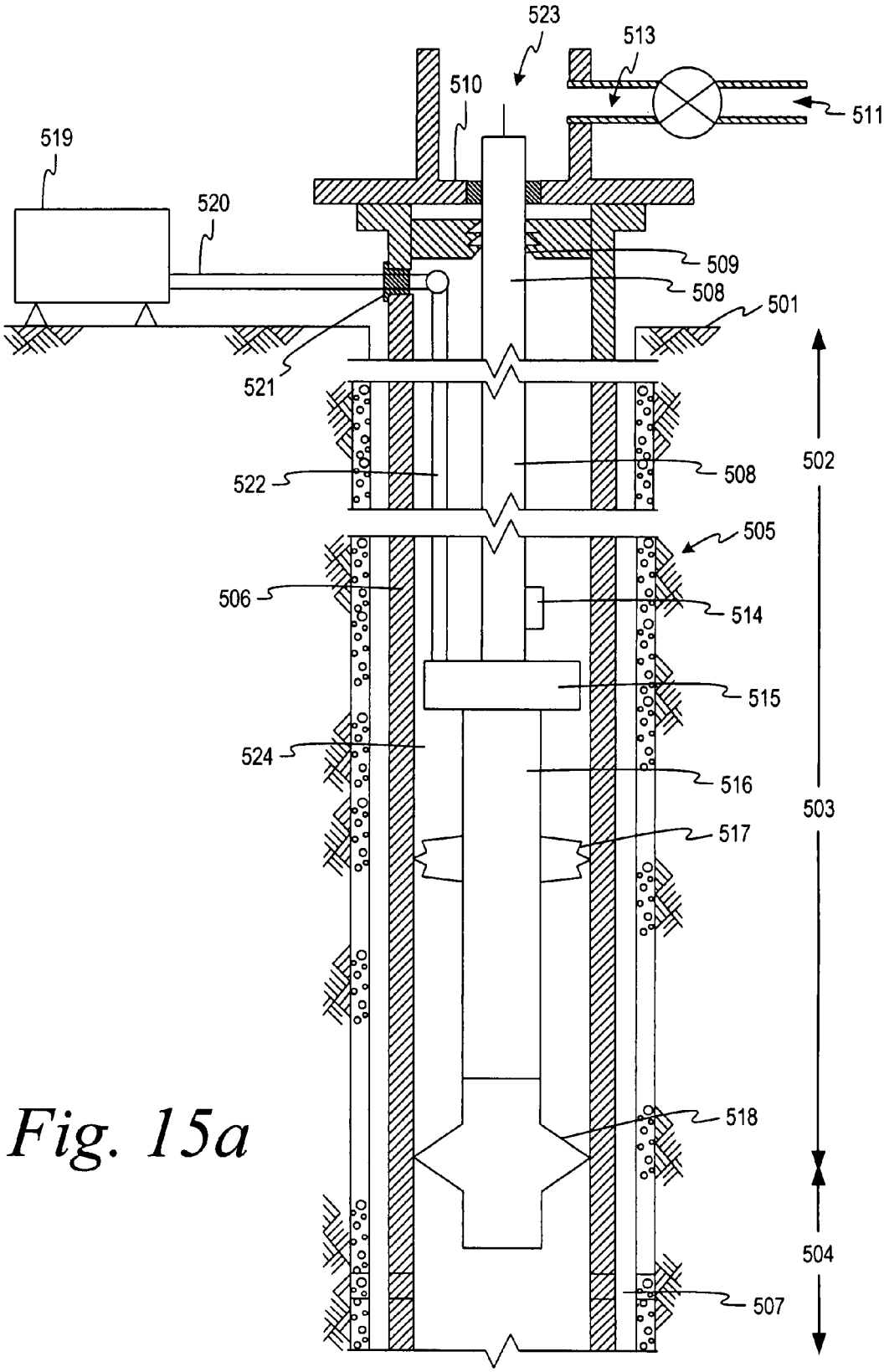
FIG. 15A illustrates apparatus how the RFT heater can be used to inject hot water into deep deposits to reduce the viscosity or provide a drive mechanism.

FIG. 15*a* illustrates the apparatus and methods that could be used to inject hot water into a deep heavy oil deposit in Alaska or California. The concept is to install a conventional oil well in a deep heavy oil deposit. The casing in the producing zone 504 is perforated at 507 so as to collect the oil as if it were in a conventional deposit. However the viscosity of the oil is such that little oil can be produced. The concept is to lower a long thin RFT heater 516 down the casing to a location just above or within the oil saturated zone 504. Water for a hot water flood is sent down into the well at a rate such that the surface of the water in the annulus 524 is well above the RFT heating tool. By so doing, this pressurizes and heats the water in the annulus so as to increase the temperature of the water without vaporization. As heat is applied, hot water is injected into the deposit such that the oil viscosity near the well bore is gradually reduced, thereby improving the ease of injecting more hot water. Depending on the pressures in the formation near the producing zone, water under pressure can be injected as needed from, the surface.

FIG. 15*a* illustrates an example of this concept where a modified armored pump motor cable 520 is used to transfer the power from the power source 519 to the RFT heating tool 516. From the surface 501, a borehole 505 is formed into the overburden 502 which lies above the lower level overburden 503 which is near the location of the RFT tool 516. The tool is located above the producing zone 504 to assure that the injection water has the same temperature along the perforations 507 in the casing 506. Injection water 511 flows into the well head 523 and then into the tubing 508 via the tubing inlet 513, and thence, via the outlet 514, into the annulus 524, over the RFT heater 516 and then into the deposit 504 via the perforations 507. The tubing 508 is constrained by the grips 509 and seal 510. The source 519 supplies power via power cable 520 to the feed through 521 to the armored cable 522. From the feed through, the armored cable is terminated on the cable to RFT heater box 515. The heater and tubing are separated from the casing by centralizers 517.

The well casing 506 is installed in the conventional way and the casing 506 is perforated at 507 in sections near the oil saturated zones. Next the RFT heater 516 is assembled and attached to centralizers 517, tubing anchor 518 and RFT connector block 515. The tubing 508 that carries the water for injection is attached to the RFT connector block 515 to support the heater. As the tubing and attachments are lowered into the well, the armored cable 522 is progressively attached to the tubing 508 to facilitate the installation. When the desired depth is reached, the cable 522 is attached to the feed through 521 and the tubing 508 position fixed by the grips 509 and seal 510. The upper well head 523 is connected to the water inlet 511. The power source 519 is connected to the feed through 521 by cable 520. Water enters the annulus 524 near the connection block 515 via outlet 514.

The RFT heater is positioned well below the earth surface 501 and the overburden or permafrost region 502. It can be located just above the pay zone 504 in region 503.

Figure 15B:
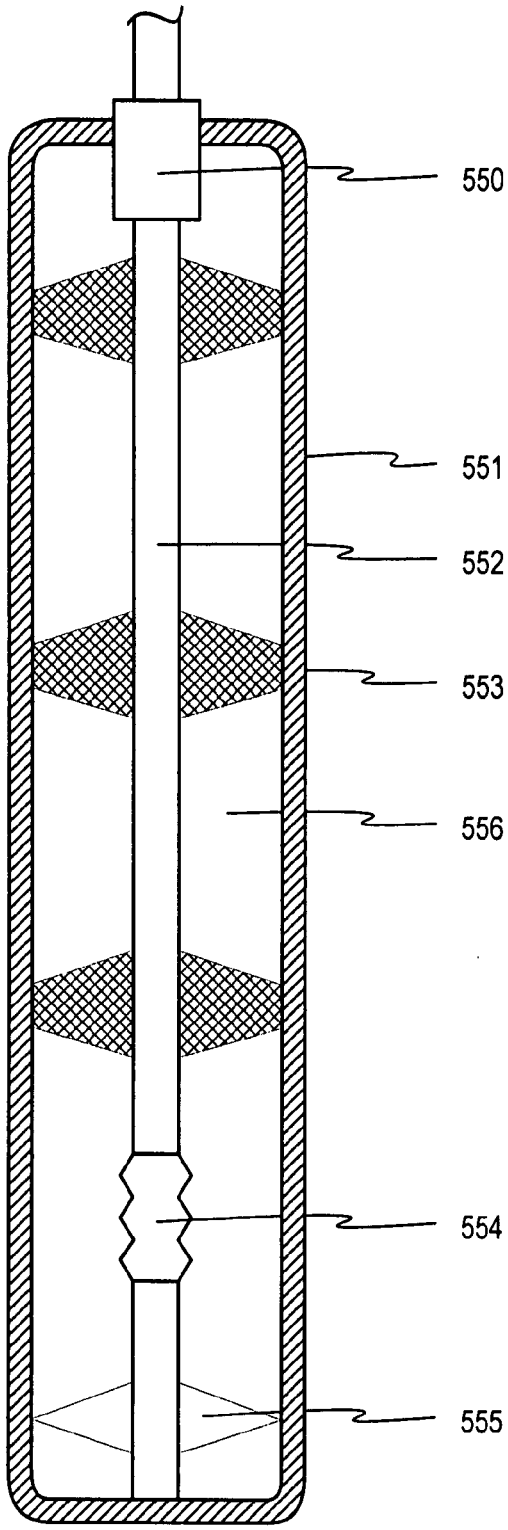
FIG. 15B illustrates an RFT heater designed to heat the water on the outer surface of the heater.

FIG. 15*b* shows a cross section of a self contained RFT heating tool. The heater is composed of a ferromagnetic casing 551 which surrounds the inner conductor 552 composed of either ferromagnetic material or aluminum covered steel or aluminum alone. The inner conductor 552 is constrained by ceramic isolators 553 and by the feed through 550, and the tubing anchor 555. An expansion joint 554 is imposed between the tubing anchor and the inner conductor. The length is dependent on the heating needs, and if needed several 20 to 50 foot sections could be combined on site, provided that no foreign material or water entered the annulus 556. Means also could be provided to fill the cavity with an inert gas.

This design requires the water in the annulus to be well above the RFT heating tool. This is needed to provide sufficient pressure to avoid vaporizing the water in the annulus. This may be done by controlling the height of the water above the of RFT heater, such that the hydrostatic pressure of the water column is sufficient to prevent vaporization. The vaporization temperature is defined in handbook steam tables (Handbook of Chemistry and Physics, CRC Press, 1980). For a maximum allowable equipment operating temperature of 428 F (220 C), a water column of about 800 feet would be needed to maintain a pressure of 336 psia, which is sufficient to prevent vaporization.

At the start of the heating, the ease of injecting into the formation could be difficult. The high viscosity of the oils in the formations would block the entry of hot water into the formation. As the near well bore formations become warmer and the viscosity reduced, the ease of injection will increase. This will require additional power dissipation in the RFT as water feed rate increases. To control these variables, sensors are needed to measure the height of the water column or the fluid pressure. Temperature sensors just above the RFT heating tool and at the base of the RFT heating tool can be used to provide data for above ground processing. The power dissipated by the RFT heating tool and the flow rate of the injection water can be used to control the process based on the data from down hole sensor and the above ground flow rate sensor.

Cyclic Hot Water Stimulation CHWS and Cyclic Steam Stimulation CSS

Similar to the foregoing hot water injection, a hot water injection and product recovery system can be considered for a cyclic hot water stimulation that uses the RFT heater. For this, the assumption is that the resource is deeply buried and not suitable for the conventional CSS method. One advantage that RFT heaters have is that the electrical power delivery and heating apparatus can withstand high temperatures, well over 300 C. As noted in the hot water flood example, a column of water 800 ft is sufficient to prevent vaporization at 220 C, as limited by equipment, such as the armored cable. If the down hole equipment can survive reliably at 300 C, as might be expected for pumps designed for shale oil recovery, then a water column of 3000 feet is sufficient to prevent vaporization at the producing zone.

The heating and production method envisions injecting hot water at temperatures up to 300 C. at pressures up to 1226 psia into oil saturated formations deeper than 3000 feet. The hot water flow patterns will be constrained by the spatial distribution of the permeability and other reservoir parameters, and thereby avoid forming a steam filled cavity near the top of the pay zone. After a suitable time interval, the RFT heating and injection of water are stopped. The down hole pressure is then reduced by pumping out the water column and recovering the in flowing oil via the perforations or screens. This reduction in pressure causes the some of water in the nearby formation to flash into steam while at the same time cooling the formation slightly, thereby providing an in situ generated gas drive to force the oil into the well, in addition to other drive mechanisms.

Figure 16:
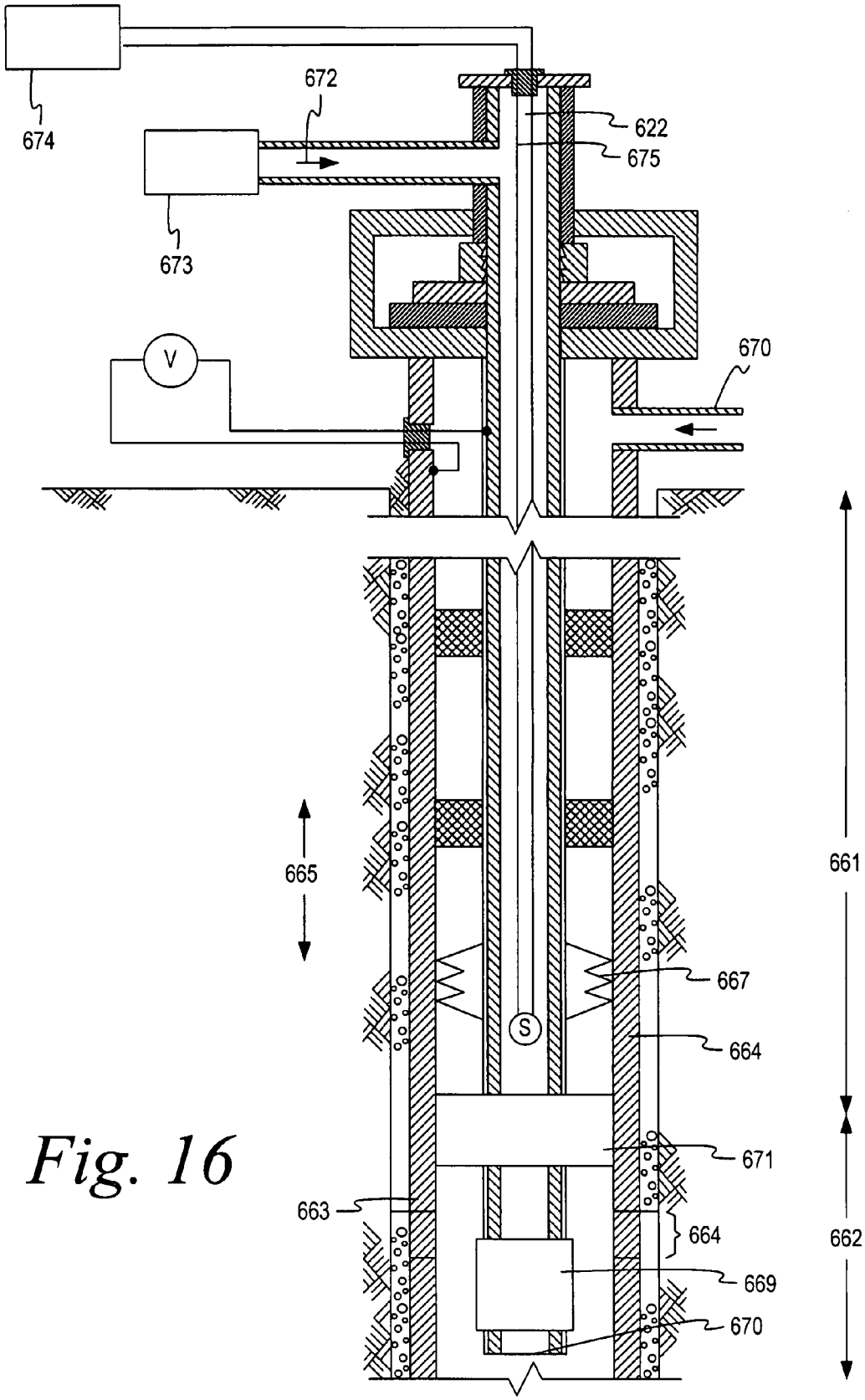
FIG. 16 shows a modification of the apparatus in FIG. 7 for cyclic hot water stimulation for a well in an oil deposit.

FIG. 16 shows a system to supply large volumes of heated water at temperatures up to 300 C. It is a modification of the FIG. 7 system that both heats and produces shale oil formations. For this, the alternate sections of oil shale and barren zones are now replaced by other formations, that is overburden 661 and oil bearing pay zones 662 as shown in FIG. 16. Here, additional casing 663 is installed with the objective of either perforating the casing 664 adjacent pay zones, or locating the screens adjacent the pay zones. The RFT heater section 665 will be located just above the pay zones by tubing anchor 667. The pump 669 could be lowered into pay zone 662. The pump 669 can be modified to permit injection at outlet 670 of water or to pump the fluids upward. Below the tubing anchor 667 a packer 671 is positioned to prevent fluids to penetrate into the annulus. The packer also contains a valve that can be forced open to drain incidental water accumulations by introducing pressurized gas from inlet pipe 670.

Water can be introduced in the pipe 672 from a deionized source 673, that was the outlet for the pumped liquids. The instrumentation subsystem 674 is connected via cable 675 to the down hole sensors. Such controls are needed to monitor the heating rates to avoid over heating or under heating the injection water.

SAGD (Steam Assisted Gravity Drive) is currently being employed to extract oil from some of the heavy oil deposits. The use of an in situ RFT steam generator may prove advantageous, especially where the use of steam is difficult or where electric power from wind generators can be used to suppress $CO_2$ emissions.

RFT heater or power delivery methods could be employed in either vertical or horizontal completions. where diffusion heating and possible subsequent convection of heat might be beneficial. The apparatus shown in FIG. 8 could be packaged as subsystem that would be inserted into a larger casing. Near the surface 201 all of the conductors, both the outer conductors 204 and inner conductor segments 205, 206 and 207 would be aluminum coated magnetic material so as to serve as a high efficiency power delivery function. At least one or both conductors that are to be positioned in the pay zone of the deposit will use magnetic material to that will dissipate heat. To do this a 2⅞ tubing could serve as the outer conductor and the inner conductor could be a ⅞ inch aluminum rod or tube. The aluminum tube would be isolated from the outer conductors by ceramic insulators. At the distal end, the aluminum tubing would be connected to the outer conductor by a tubing anchor and the bottom sealed by a packer. This assembly could be installed from the oil well platform as if it were a production tubing with a rod pump. The heater could be used to heat injection water or reduce the viscosity of the oil very near and within the well bore. Such a method is best suited for slowly producing segment of long horizontal completions wherein most of the heat is dissipated at the distal end.

Non Hydrocarbon Resources

Also, the RFT may be amenable to supply the heat needed to recover non-hydrocarbon mineral deposits such as nahcolite or dawsonite directly via hot water solution mining. Alternatively, RFT can be used to disassociate in situ minerals to facilitate the recovery or processing of the mineral.

It also can be used heat other mineral deposits by thermal diffusion to increase the solubility of a valuable mineral (silver) in a leaching solution to accelerate recovery of valuable minerals by solution mining.

Definitions

The terms wire, sheath and conduit are used to define the ICP heater. The terms rod, tubing and casing are used to define the RFT heater. The electromagnetic skin effect terms are those used and defined in Ramo (1965) and the magnetic materials and effects terms as used in Attwood (1967). The term frequency refers to the repetition rate of a waveform, such as sinusoidal or square wave, and for non sinusoidal waves refers to the region of maximum spectral content.

References

Bridges, J. and S. Johansen: Electrically Enhanced Oil Recovery, Conference Paper C-10; Modern Exploration and Improved Oil and Gas Recovery Methods, 1995

Bridges, J. G. Sresty, D. Kathari, and R. Snow: Physical and electrical properties of oil shale: The Fourth Annual Oil Shale Conversion Conference, Department of Energy, Laramie Energy Technical Center, Denver, Colo., Mar. 24-26, 1981

Bridges, J. J. Enk, R. Snow and G. Sresty: Physical and electrical properties of oil shale, Presented at the 15$^{th}$ Oil Shale Symposium, Colorado School of Mines, Golden Colo., April 1982a.

Bridges, J., G. Stresty, H. Dev, and R. Show: Kenetics of low temperature pryolsysis of oil shale by the RF process, 15$^{th}$ Oil Shale Symposium, Colorado School of Mines, Golden Colo., April 1982b Baker-Jarvis, J. and R Inguva: Mathematical model for in situ oil shale retorting by electromagnetic radiation, Department of Energy Postdoctoral Fellowship Grant, DEAS20-8ILC10783, 1984

Anon. 2000, STARS advance process thermal reservoir simulator version 2000: Computer Modeling Group Ltd, Calgary, AB Ramo, et al. Fields and Waves in Communication Electronics, John Wiley and Sons, New York, 1965

Dorf R. C editor in Chief, The Electrical Engineering Handbook, IEEE Press, CRC Press, 1993

Ravinder, R.: Promising Progress in Field Application of Reservoir Electrical Heating Methods, SPE 69709, 2001

Stroemich, C. P., F. E. Vermeulen, F. S. Chute and E. Sumbar, Wellbore power transmission for in situ electrical heating, AOSTRA Journal of Research 6 (1990) 273

McGee, B. C. W. and F. E. Vermuelen, Power losses in steel pipes delivering very large currents, IEEE Transactions on Power Delivery, Vol. 17, No. 1, January 2001

Attwood, S. S., Electromagnetic Field, Dover, 1967

Macchiarella, G.: Novel Approach to the Synthesis of Microwave Diplexers, IEEE Transactions of Microwave Theory and Techniques, Vol. 54, No. 12, December 2006

The invention claimed is:

1. A method of heating at least a part of a subsurface hydro carbonaceous earth formation, comprising:

forming a borehole into or adjacent to said formation, inserting an RF electric heater including two concentric tubular conductors into the borehole, the conductors including top and bottom portions and being electrically connected to each other near their bottom portions, at least a portion of at least one of the conductors comprising a ferromagnetic material, the conductors being connected at their top portions to an AC power supply, said AC power supply having an AC output having a selectable output frequency and current, wherein the two concentric tubular conductors include an inner conductor and an outer conductor, at least one longitudinal segment of at least one of said inner and outer conductors varies in at least one of geometry, chemical composition or heat treatment, and simultaneously using at least two frequencies in said AC output to preferentially heat a selected one of said longitudinal ferromagnetic segments.

2. The method of claim 1 further comprising controlling the magnetic properties of said ferromagnetic material by cutting longitudinal slots into the surface of said ferromagnetic material and filling said slots with a non-ferromagnetic material.

3. A method of heating at least a part of a subsurface hydrocarbonaceous earth formation, comprising forming a borehole into or adjacent to said formation, inserting elongated coaxial inner and outer conductors into the borehole, said inner and outer conductors being electrically connected to each other at a depth below the top of said formation, a portion of at least one of said conductors comprising a ferromagnetic material to form a down hole impedance having resistive and reactive components, said ferromagnetic material being adjacent to a portion of said formation to be heated, connecting an AC power source to at least said outer conductor to produce heat in at least one of said conductors, said AC power source having an AC output having a controllable frequency and amplitude, transferring thermal energy from said heated conductor directly to said formation by at least one heat transfer mechanism selected from the group consisting of thermal diffusion, thermal radiation and thermal convection, controlling the phase angle between the real and the reactive components by varying at least one of the input current and frequency, delivering resistive power to said ferromagnetic material, recovering reactive energy from said ferromagnetic material, dissipating more heat from portions of said conductors that are within the depth range of said formation than from other portions of said conductors and simultaneously using at least two frequencies in said AC output to preferentially heat a selected one of said longitudinal ferromagnetic segments.

4. A method of heating at least a part of a subsurface hydrocarbonaceous earth formation, comprising forming a borehole into or adjacent to said formation, inserting elongated coaxial inner and outer conductors into the borehole, said inner and outer conductors being electrically connected to each other at a depth below the top of said formation, a portion of at least one of said conductors comprising a ferromagnetic material to form a down hole impedance having resistive and reactive components, said ferromagnetic material conducting current from said AC power source in a surface region of the conductor due to the skin effect phenomenon, and being located adjacent to a portion of said formation to be heated, connecting an AC power source to at least said outer conductor to produce heat in at least one of said conductors, said AC power source producing an AC output having a selectable frequency, transferring thermal energy from said heated conductor directly to said formation by at least one heat transfer mechanism selected from the group consisting of thermal diffusion, thermal radiation and thermal convection, selecting said frequency such that the ratio of the AC downhole impedance to the DC downhole resistance is greater than about 3, and simultaneously using at least two frequencies in said AC output to preferentially heat a selected one of said longitudinal ferromagnetic segments.

5. A method of heating at least a part of a subsurface hydro carbonaceous earth formation, comprising:

forming a borehole into or adjacent to said formation, inserting an RF electric heater including two concentric tubular conductors into the borehole, said conductors including an inner conductor and an outer conductor, said conductors further including top and bottom portions and being electrically connected to each other proximate their bottom portions, at least a portion of at least one of the conductors comprising a ferromagnetic material, said conductors having a wall thickness configured to provide robustness and reliable operation in an environment of an oil well, said conductors being connected at their top portions to an AC power supply, said AC power supply having an AC output having a selectable output frequency and current, and selecting the frequency and the current configured to cause said current to flow through a skin layer of at least one of said conductors, wherein a depth of the skin layer is independent of the thickness of at least one of said conductor walls, wherein said conductors are firmly attached to each other at their bottom portions and tensioning means for maintaining tension in said conductors are installed at the top portions of said conductors to enhance said reliability of the installation and to compensate for different expansion rates between said conductors due to heating.

6. The method of claim 5, wherein said frequency is selected to be greater than 1000 Hz in order to produce sufficient impedance due to a skin effect occurring in at least one of said conductors in order to generate a heating rate of at least 100 watts/m when said current is selected to be at least 100 amps.

7. The method of claim 5, wherein said RF heater is configured to be assembled on an oil well platform.

8. The method of claim 5, wherein said conductors have a wall thickness selected from a list of API standard wall thicknesses for oil well pipe, including API specification 5CT or 5A to provide enhanced reliability when used in oil wells.

9. The method of claim 5, wherein a nominal diameter of said conductors is at least 2 inches, said nominal diameter being configured to provide strength and increased reliability when used in oil wells.

10. The method of claim 5, wherein said wall thickness of said conductors is selected from values in API standards to provide sufficient stiffness so that said conductors may be kept apart by electrically insulating centralizers separated along said conductor length so as to transfer heat generated in said inner conductor to said outer conductor primarily by radiation.

11. The method of claim 5, wherein liquids are withdrawn from said formation through one of said tubular conductors, said liquids being withdrawn by means of an electrically non-conductive tubing attached to one of said tubular conductors at the wellhead.

12. The method of claim 5, wherein a tubing anchor provides said connection at said bottom.

13. The method of claim 12, wherein said tubing anchor makes several molecular contact points with said outer conductor to reduce contact resistance to assure reliable electrical continuity.

14. The method of claim 5, wherein an annulus between said inner conductor and said outer conductor is sealed at said bottom portions to prevent ingress of fluids.

15. The method of claim 5, wherein said wall thickness exceeds said skin layer depth to cause said current to flow within said skin layer adjacent to an inner surface of said outer conductor, to minimize electric current flow near an outer surface of said outer conductor and thus prevent electrolytic surface corrosion when said outer surface of said outer conductor is exposed to reservoir fluids.

16. The method of claim 15, wherein said frequency is selected to be higher than 1000 Hz to minimize electrolytic corrosion.

17. The method of claim 5, wherein said borehole passes through an overburden section, wherein at least a portion of at least one of said conductors is non-magnetic, and wherein the conductors situated in the section of the borehole adjacent to the overburden have sufficient dimensions to deliver AC power at the megawatt level to a heater section in a deep formation.

18. The method of claim 17, wherein the deep formation has a depth greater than approximately 100 meters.

19. The method of claim 5, wherein water is used for stimulation of oil production, said water being heated in or above said formation by said RF heater inserted into said borehole, and supplied with water pressurized by the head of water in said borehole.

20. The method of claim 5, wherein steam for stimulation of oil production is produced by boiling water in a formation by said RF heater inserted into said borehole.

21. The method of claim 5, wherein at least a portion of at least one of said conductors is perforated with vertical slots to impede magnetic flux and reduce heating in selected sections of the RF heater.

22. A method of heating at least a part of a subsurface hydro carbonaceous earth formation, comprising:

forming a borehole into or adjacent to said formation, inserting an RF electric heater including two concentric tubular conductors into the borehole, said conductors including an inner conductor and an outer conductor, said conductors further including top and bottom portions and being electrically connected to each other proximate their bottom portions, at least a portion of at least one of the conductors comprising a ferromagnetic material, said conductors having a wall thickness configured to provide robustness and reliable operation in an environment of an oil well, said conductors being connected at their top portions to an AC power supply, said AC power supply having an AC output having a selectable output frequency and current, and selecting the frequency and the current configured to cause said current to flow through a skin layer of at least one of said conductors, wherein a depth of the skin layer is independent of the thickness of at least one of said conductor walls, wherein liquids are withdrawn from said formation through one of said tubular conductors, said liquids being withdrawn by means of an electrically non-conductive tubing attached to one of said tubular conductors at the wellhead, wherein said non-conductive tubing is surrounded by a radio-frequency choke configured to contain RF fields inside said tubular conductors.

23. The method of claim 22, wherein said conductors are firmly attached to each other at their bottom portions and tensioning means for maintaining tension in said conductors are installed at the top portions of said conductors to enhance said reliability of the installation and to compensate for different expansion rates between said conductors due to heating.

24. A method of heating at least a part of a subsurface hydro carbonaceous earth formation, comprising:

forming a borehole into or adjacent to said formation, inserting an RF electric heater including two concentric tubular conductors into the borehole, said conductors including an inner conductor and an outer conductor, said conductors further including top and bottom portions and being electrically connected to each other proximate their bottom portions, at least a portion of at least one of the conductors comprising a ferromagnetic material, said conductors having a wall thickness configured to provide robustness and reliable operation in an environment of an oil well, said conductors being connected at their top portions to an AC power supply, said AC power supply having an AC output having a selectable output frequency and current, and selecting the frequency and the current configured to cause said current to flow through a skin layer of at least one of said conductors, wherein a depth of the skin layer is independent of the thickness of at least one of said conductor walls, wherein at least a portion of at least one of said conductors is perforated with vertical slots to impede magnetic flux and reduce heating in selected sections of the RF heater.

25. The method of claim 24, wherein said vertical slots are filled with non-magnetic material.

26. A method of heating at least a part of a subsurface hydro carbonaceous earth formation, comprising:

forming a borehole into or adjacent to said formation, inserting an RF electric heater including two concentric tubular conductors into the borehole, said conductors including an inner conductor and an outer conductor, said conductors further including top and bottom portions and being electrically connected to each other proximate their bottom portions, at least a portion of at least one of the conductors comprising a ferromagnetic material, said conductors having a wall thickness configured to provide robustness and reliable operation in an environment of an oil well, said conductors being connected at their top portions to an AC power supply, said AC power supply having an AC output having a selectable output frequency and current, selecting the frequency and the current configured to cause said current to flow through a skin layer of at least one of said conductors, wherein a depth of the skin layer is independent of the thickness of at least one of said conductor walls, and selecting said AC power supply configured to recover inductive and harmonic power from said RF heater so that said AC power supply operates with a maximum efficiency and presents a resistive load to an input from said AC power supply, wherein said AC power supply includes feedback circuitry that automatically adjusts the output frequency so that a capacitive component of said AC power supply is equal to an inductive component of said RF heater to maximize efficiency of said AC power supply and to present said resistive load to said input from said AC power supply.

27. The method of claim 26, wherein said conductors are firmly attached to each other at their bottom portions and tensioning means for maintaining tension in said conductors are installed at the top portions of said conductors to enhance said reliability of the installation and to compensate for different expansion rates between said conductors due to heating.

28. The method of claim 26, wherein an output of said AC power supply contains a resonant circuit of inductive and capacitive components as part of said feedback circuitry that is configured to measure an output phase angle and to send a signal to a switching transistor to automatically control and maintain said output frequency.

* * * * *